US007411766B1

(12) United States Patent
Huang et al.

(10) Patent No.: US 7,411,766 B1
(45) Date of Patent: Aug. 12, 2008

(54) CIRCUIT INTERRUPTING DEVICE WITH END OF LIFE TESTING FUNCTIONS

(75) Inventors: Huadao Huang, c/o Shanghai Meihao Electric Inc., No. 58 Shahe Road, Jiangqiao Town, Jiang Borough, Shanghai (CN); Lu Huayang, Shanghai (CN)

(73) Assignee: Huadao Huang, Shanghai (CN)

( * ) Notice: Subject to any disclaimer, the term of this patent is extended or adjusted under 35 U.S.C. 154(b) by 0 days.

(21) Appl. No.: 11/822,562

(22) Filed: Jul. 6, 2007

(30) Foreign Application Priority Data

Feb. 14, 2007 (CN) ..... 2007 2 0005068 U
Feb. 15, 2007 (CN) ..... 2007 2 0103644 U

(51) Int. Cl.
*H01H 3/00* (2006.01)

(52) U.S. Cl. ..... 361/42; 335/13; 335/17

(58) Field of Classification Search ..... 361/42–50; 335/6, 13, 17

See application file for complete search history.

(56) References Cited

U.S. PATENT DOCUMENTS 4,386,338 A 5/1983 Doyle et al.
4,518,945 A 5/1985 Doyle et al.
4,595,894 A 6/1986 Doyle et al.
5,202,662 A 4/1993 Bienwald et al.
5,654,857 A 8/1997 Gershen
5,680,287 A 10/1997 Gernhard et al.
5,963,408 A 10/1999 Neiger et al.
6,040,967 A 3/2000 DiSalvo
6,052,265 A 4/2000 Zaretsky et al.
6,111,733 A 8/2000 Neiger et al.
6,226,161 B1 5/2001 Neiger et al.
6,246,558 B1 6/2001 DiSalvo et al.
6,252,407 B1 6/2001 Gershen
6,282,070 B1 8/2001 Ziegler et al.
6,288,882 B1 9/2001 DiSalvo et al.
6,309,248 B1 10/2001 King
6,381,112 B1 4/2002 DiSalvo
6,437,953 B2 8/2002 DiSalvo et al.

(Continued)

*Primary Examiner*—Ramon M Barrera
(74) *Attorney, Agent, or Firm*—Fei-Fei Chao; Andrews Kurth LLP

(57) ABSTRACT

The present invention provides a circuit interrupting device which comprises a novel reset mechanism to allow a user to test whether the device is wired properly. The novel reset mechanism includes a reset conducting apparatus which contains a reset start switch (KR-4). The KR-4 contains a first conducting pin, a second conducting pin, and a conducting bridge. When the reset button is depressed and the device is wired properly, the KR-4 is closed to allow the conducting bridge to be in contact with both the first and the second conducting pins so as to reset the device. The present invention also provides a circuit interrupting device which is capable of automatically checking the components of the circuit interrupting device (i.e., the end of life test) through a novel status test switch (KR-1). The KR-1 comprises a flexible metal piece and a simulated leakage current controlling resistor, which is located underneath of the flexible metal piece. When the circuit interrupting device is properly wired and at a tripped state, without touching any parts of the circuiting interrupting device, the KR-1 is closed which generates a simulated leakage current to allow the device to conduct the end of life test. If all of the components in the device are functioned properly, a reset indicating light is lit.

35 Claims, 16 Drawing Sheets

U.S. PATENT DOCUMENTS

| | | | | |
|---|---|---|---|---|
| 6,469,881 | B2 | 10/2002 | Gershen et al. | |
| 6,580,344 | B2 | 6/2003 | Li | |
| 6,671,145 | B2 | 12/2003 | Germain et al. | |
| 6,864,766 | B2 | 3/2005 | DiSalvo et al. | |
| 6,963,260 | B2 | 11/2005 | Germain et al. | |
| 7,019,952 | B2 | 3/2006 | Huang et al. | |
| 7,049,910 | B2 | 5/2006 | Campolo et al. | |
| 7,049,911 | B2 | 5/2006 | Germain et al. | |
| 7,164,564 | B1 * | 1/2007 | Finlay et al. | 361/42 |
| 7,173,799 | B1 * | 2/2007 | Weeks et al. | 361/42 |

* cited by examiner

CIRCUIT INTERRUPTING DEVICE WITH END OF LIFE TESTING FUNCTIONS

RELATED APPLICATION

This application claims the priority of Chinese Patent Application Nos. 200720005068.4, filed on Feb. 14, 2007 and 200720103644.9, filed on Feb. 15, 2007, which are herein incorporated by reference.

FIELD OF THE INVENTION

The present invention relates to a circuit interrupting device which comprises a novel reset mechanism to allow a user to test whether the device is wired properly. The novel reset mechanism includes a reset conducting apparatus which contains a reset start switch (KR-4). The KR-4 contains a first conducting pin, a second conducting pin, and a conducting bridge. When the reset button is depressed and the device is wired properly, the KR-4 is closed to allow the conducting bridge to be in contact with both the first and the second conducting pins so as to reset the device. The present invention also relates to a circuit interrupting device which is capable of automatically checking the components of the circuit interrupting device (i.e., the end of life test) through a novel status test switch (KR-1). The KR-1 comprises a flexible metal piece and a simulated leakage current controlling resistor, which is located underneath of the flexible metal piece. When the circuit interrupting device is properly wired and at a tripped state, without touching any parts of the circuiting interrupting device, the KR-1 is closed which generates a simulated leakage current to allow the device to conduct the end of life test. If all of the components in the device are functioned properly, a reset indicating light is lit.

BACKGROUND OF THE INVENTION

Circuit interrupting devices, such as ground fault circuit interrupters (GFCIs), arc fault circuit interrupters (AFCIs), and circuit breakers, have been widely used by consumers since 1970s. Nowadays, due to household safety concerns, there are needs for GFCIs with extra safety features. According to new UL standards under 943A which was implemented on Jul. 28, 2006, a GFCI is required not only to have reverse wiring protection, but also to be able to provide a user with indications when the GFCI has reached the end of its service life and is no longer capable of providing ground fault protection, and cutoff electricity on the user accessible plug of the GFCI. That is because for most of the GFCIs currently available on the market, when their service life ends, resetting by pressing the reset button is still possible, which gives the users a false sense of security that they are still under proper protection of the GFCI, while in fact the GFCIs' capability of sensing a ground fault and cutting off the electricity due to a ground fault has been compromised. Thus, when a ground fault occurs, the GFCI is unable to provide any protection, which can result in fatal electric shocks. Additionally, current GFCIs do not have the capability to prevent reverse wiring errors. Additionally, current GFCIs do not have the capability to prevent reverse wiring errors.

SUMMARY OF THE INVENTION

The present invention provides a novel circuit interrupting device which is capable of establishing/disconnecting electrical continuity between a power source, an output load, and a user accessible load. The circuit interrupting device comprises a reset button and a reset conducting apparatus which comprises a reset start switch (KR-4) operationally connecting to the reset button so that when the circuit interrupting device is wired properly, a depression of the reset button allows the KR-4 switch to close.

The KR-4 comprises a first conducting pin, a second conducting pin, and a conducting bridge. The first conducting pin has a first end and a second end. The first end of the first conducting pin is adapted to electrically connect to ground via a silicon controlled rectifier (SCR). The second conducting pin has a first end and a second end. The first end of the second conducting pin is adapted to electrically connect to a hot wire at an input end of a power source via a solenoid coil. The second end of each of the first and the second conducting pins has an upper conducting piece and a lower conducting piece separated by a recessed slot. The conducting bridge can electrically connect to the first conducting pin and the second conducting pin by contacting with the upper conducting pieces or the lower conducting pieces of the first and second conducting pins.

The reset conducting apparatus is located at the bottom of a tripper, which is a part of the tripping device. The first and the second conducting pins are shaped like an "F." The conducting bridge is rested at the recessed slot between the upper conducting piece and the lower conducting piece and not connected to the first and the second conducting pins when the circuit interrupting device is at a tripped state.

When the reset button is pressed, the conducting bridge is pressed against each of the lower conducting piece of the first and the second conducting pins.

Furthermore, the reset conducting apparatus further comprises a reset switch box having a spring receiving slot in the center. There is a directional spring located between the conducting bridge and the spring receiving slot of the reset switch box. When the reset button is depressed, the directional spring is compressed to allow the conducting bridge to press against each of the lower conducting piece of the first and second conducting pins. When the reset button and the tripper are in the released state, the conducting bridge is rested at the recessed slot between the upper conducting piece and the lower conducting piece. When the reset button is reset, the directional spring is relaxed which allows the conducting bridge to be contacted with each of the upper conducting piece of the first and second conducting pins.

The circuit interrupting device is a ground fault circuit interrupter, an arc fault circuit interrupter, an immersion detection circuit interrupter, an appliance leakage circuit interrupter, or a circuit breaker.

The circuit interrupting device further comprises a tripping device. The tripping device contains (1) a tripper which has an aperture to receive a directional lock extended from said reset button; (2) a locking device having a locking spring and containing a first through hole and a second through hole; the first through hole is capable of aligning with the aperture of the tripper to receive the directional lock extended from the reset button; and the locking device threads through said tripper; and (3) a solenoid coil (SOL) having a plunger. When the SOL is energized, the plunger plunges onto a side wall of the locking device causing the first through hole to align with the aperture of the tripper to reset or trip the circuit interrupting device so as to connect or disconnect the electrical continuity of the circuit interrupting device.

The second through hole of the locking device receives an upward inclined handle of a rotatable tripping lever. The rotatable tripping lever further comprises a pair of rotating shafts protruding on both sides of the rotatable tripping lever, a level axis, and a v-shaped slot capable of receiving an end of an arm extended from a test button.

The pair of the rotating shafts on the rotatable tripping lever are secured in a pair of vertical directional slots within a solenoid coil support.

The circuit interrupting device further comprises a pair of metal pieces which are situated along a side of the rotatable tripping lever in the solenoid coil support. This pair of metal pieces does not contact with each other when the rotatable tripping lever is not rotated. But when the rotatable tripping lever is rotated upward, the side of the rotatable tripping lever pushes the pair of the metal pieces to be in contact with each other. One of this pair of the metal pieces is adapted to electrically connect to a neutral wire at the input end of the power source via a resistor; and the other one of this pair of the metal pieces is adapted to electrically connect to a hot wire of an output end.

The circuit interrupting device has a test button, which has a first level and a second level of depression. When the test button is depressed at the first level, the end of the extended arm of the test button pushes the v-shaped slot of the rotatable tripping lever to cause the rotatable tripping lever to rotate around the lever axis and thereby pushes the pair of metal pieces to be in contact with each other, thereby simulated a fault to test components of the circuit interrupting device. A depression of the test button at the second level causes the circuit interrupting device to be mechanically tripped.

The components of the circuit interrupting device can be tested by the depression of the test button at the first level comprise a differential transformer (DT), an integrated circuit (IC), a silicon controlled rectifier (SCR), and a solenoid coil (SOL).

The circuit interrupting device further comprises a first pair of flexible metal pieces and a second pair of flexible metal pieces. One end of each of the first pair of the flexible metal pieces passes through a differential transformer and is operationally connected to a hot power input end or a neutral power input end. The other end of each of the first pair of the flexible metal pieces has a movable contact point. One end of each of the second pair of the flexible metal pieces is operationally connected to a hot power output end or a neutral power output end. The other end of each of the second pair of the flexible metal pieces has a movable contact point.

The circuit interrupting device further comprises a pair of output conductors connected to the user accessible load and positioned in the housing. Each of the output conductors contains a pair of fixed contact points. The movable contact point of each of the first pair of the flexible metal pieces and the movable contact point of each of the second pair of flexible metal pieces are capable of connecting/disconnecting to each of the fixed contact points of the pair of output conductors respectively. Each of the first pair of the flexible metal pieces and each of the second pair of the flexible metal pieces are soldered on a circuit board and are not directly connected to the input end and the output end. Also, each of the movable contact points of the first pair of the flexible metal pieces is in a different cross sectional plane from each of the movable contact points of the second pair of the flexible metal pieces. Furthermore, the first pair of the flexible metal pieces and the second pair of the flexible metal pieces are above a pair of cantilever arm at both sides of the tripper.

Each of the pair of the output conductor comprises a pair of gripping wing pieces protruded to output socket holes at a front lid of the housing.

When each of the movable contact point of each of the first pair of flexible metal pieces is connected to each of the fixed contact points of the pair of output conductors, electrical current is conducted from the power source to the user accessible load. When each of the movable contact point of each of the second pair of flexible metal pieces is connected to each of the fixed contact points of the pair of output conductors, electrical current is conducted from the user accessible load to the output load.

The circuit interrupting device further comprises a simulated leakage current controlling resistor, which is located underneath one of the first pair of flexible metal pieces that is adapted to electrically connected to a neutral wire of said input end. The simulated leakage current controlling resistor has a first end and a second end. The first end of the simulated leakage current controlling resistor is capable of contacting with one of the first pair of flexible metal pieces; the second end of the simulated leakage current controlling resistor is adapted to electrically connect to the hot wire of the input end via the solenoid coil (SOL). The simulated leakage current controlling resistor and one of the first pair of flexible metal pieces form a status test switch (KR-1).

When the circuit interrupting device is powered on and at a tripped state, the KR-1 is closed due to the simulated leakage current controlling resistor contacting with one of the first pair of flexible metal pieces. The KR-1 is closed without a depression of the reset button.

Also, when the circuit interrupting device is reset, the KR-1 is opened due to the separation of the simulated leakage current controlling resistor from one of the first pair of flexible metal pieces.

When the KR-1 is closed, the circuit interrupting device is automatically performing a test of the components of the circuit interrupting device.

The components of the circuit interrupting device that can be tested include, but are not limited to, a differential transformer, an integrated circuit, a silicon silicon controlled rectifier (SCR), and a solenoid coil.

The circuit interrupting device further contains a reset indicating light. One end of the reset indicating light is connected to a negative pole of the power source through the SCR and the other end is connected to the hot wire of the input end of said power source through a resistor and the solenoid coil. When all of the components function properly, a reset indicating light is lit. The circuit interrupting device further comprises a power output indicator light. When the circuit interrupting device has power output, the power output indicator light is lit.

There is a pair of hooked pins which is positioned above the first pair of flexible metal pieces. The pair of hooked pins has an upper end and a lower end; each of the upper end of the hooked pins is clamped to a mid-level support within the housing. Each of the lower end of the hooked pins has a cylindrical platform which is pressed on each of the pair of flexible metal pieces when the circuit interrupting device is powered on and at a tripped state to cause the simulated leakage current controlling resistor to be in close contact with one of the first pair of flexible metal pieces so as to generate a simulated leakage current. Each of the pair of hooked pins comprises a spring at outside of each of the pair of hooked pins.

The solenoid coil has a coil protection cover which is placed at outside of the solenoid coil.

The present invention also provides a circuit interrupting device which comprises a reset button; and a status test switch (KR-1) containing a flexible metal piece having a first end and a second end. The first end of the flexible metal piece is soldered to a circuit board. The second end of the flexible metal piece is capable of contacting a simulated leakage current controlling resistor located underneath the flexible metal piece. The flexible metal piece is adapted to electrically connected to a neutral wire of an input end of a power source.

The simulated leakage current controlling resistor has a first end and a second end. The first end of the simulated leakage current controlling resistor is capable of contacting the flexible metal piece. The second end of the simulated leakage current controlling resistor is adapted to connect to the circuit board and electrically connect to a hot wire of the input end via a solenoid coil.

When the flexible metal piece is adapted to electrically connect to the neutral wire of the input end, the simulated leakage current controlling resistor is adapted to electrically connect to the hot wire of the input end and vise versa.

When the circuit interrupting device is powered on and at a tripped state, without depressing the reset button, the flexible metal piece is in contact with the simulated leakage current controlling resistor so as to close the KR-1. When the circuit interrupting device is reset, the flexible metal piece is separated from the simulated leakage current controlling resistor to open the KR-1.

Also, when the KR-1 is closed, the flexible metal piece, the simulated leakage current controlling resistor and the solenoid coil form a loop to automatically generate a simulated leakage current to test components of the circuit interrupting device without a depression of the reset button.

The components of the circuit interrupting device that can be tested by the simulated leakage current include, but are not limited to, a differential transformer, an integrated circuit, a silicon controlled rectifier (SCR), and a solenoid coil.

When all of the components of the circuit interrupting device are functioned properly, a reset indicating light is lit.

BRIEF DESCRIPTION OF THE DRAWINGS

The detailed description will refer to the following drawings in which like numerals refer to like elements, and in which:

FIG. 5-B is a partial cross-sectional view along the A-A line in FIG. 3, illustrating the GFCI when the reset button is reset and the GFCI is in a normal state;

FIG. 5-C is a partial cross-sectional view along the A-A line in FIG. 3, illustrating the GFCI the instant the reset button is pressed;

FIG. 6-B is a partial cross-sectional view along the B-B line in FIG. 3, illustrating the GFCI the instant the reset button is pressed;

FIG. 6-C is a partial cross-sectional view along the B-B line in FIG. 3, illustrating the GFCI when the reset button is reset and the GFCI is in a normal state;

FIG. 7-B is a partial cross-sectional view along the C-C line in FIG. 3, illustrating the GFCI when the test button is pressed;

FIG. 7-C is a partial cross-sectional view along the C-C line in FIG. 3. illustrating the GFCI when the test button is pressed and the GFCI is tripped with no power output;

FIG. 7-D is a partial cross-sectional view along the C-C line in FIG. 3, illustrating the GFCI when the test button is continually pressed to forcibly release the GFCI and to cut off the power output of the GFCI;

DETAILED DESCRIPTION OF THE INVENTION

The present invention describes a circuit interrupting device, which includes, but is not limited to, a ground fault circuit interrupter (GFCI), an arc fault circuit interrupter (AFCI), an immersion detection circuit interrupter, an appliance leakage circuit interrupter, or a circuit breaker. The preferred circuit interrupting device is a GFCI.

The following experimental designs and result are illustrative, but not limiting the scope of the present invention. Reasonable variations, such as those occur to reasonable artisan, can be made herein without departing from the scope of the present invention. For example, while an exemplary GFCI is illustrated and described with respect to the Figures, one skilled in the art will appreciate that the description equally applies to other circuit interrupting devices. Also, in describing the invention, specific terminology is employed for the sake of clarity. However, the invention is not intended to be limited to the specific terminology so selected. It is to be understood that each specific element includes all technical equivalents which operate in a similar manner to accomplish a similar purpose.

Figure 1:
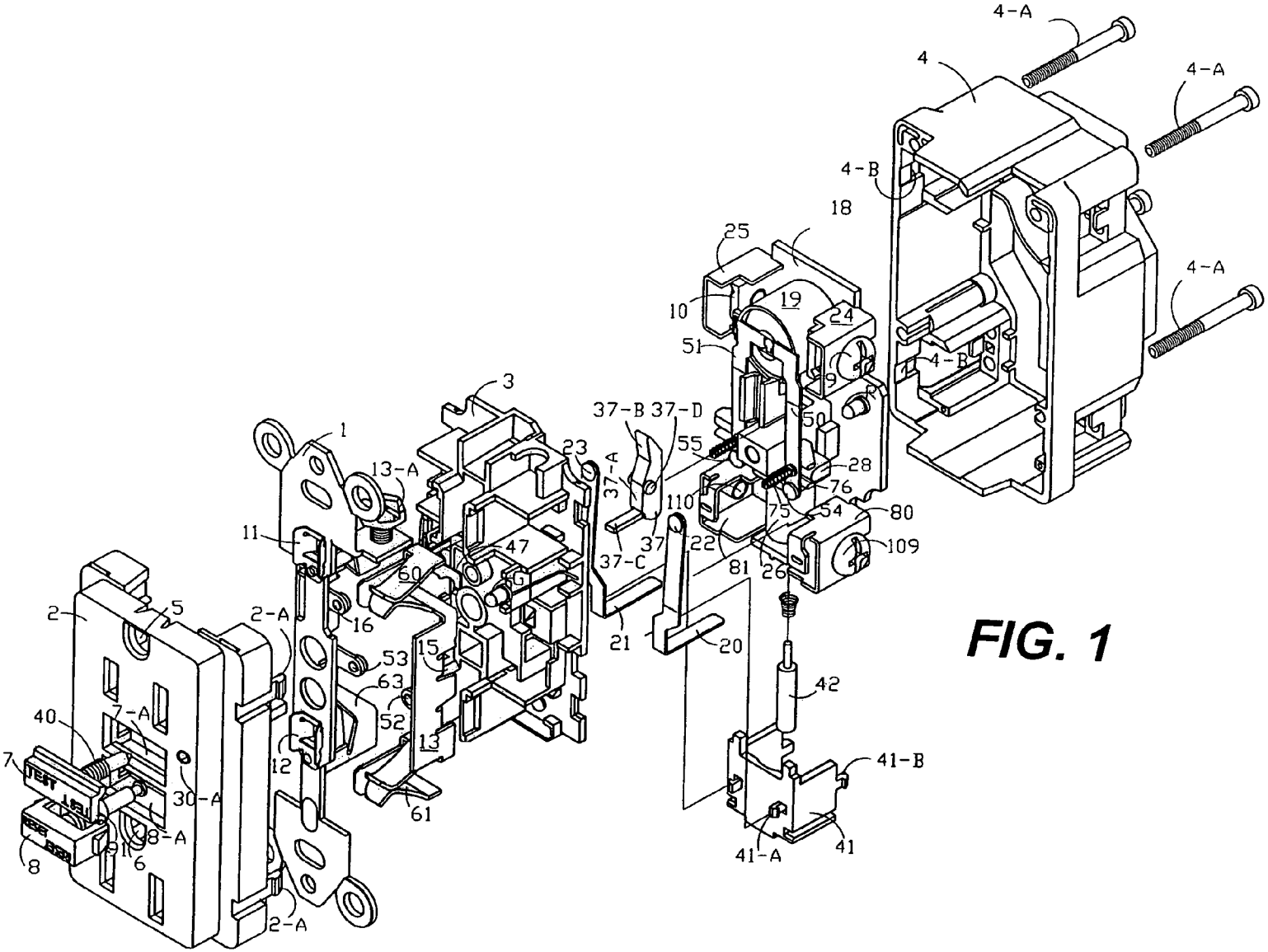
FIG. 1 is an exploded view illustrating the structure of an exemplary ground fault circuit interrupter (GFCI) with a reset conducting apparatus.
Figure 2:
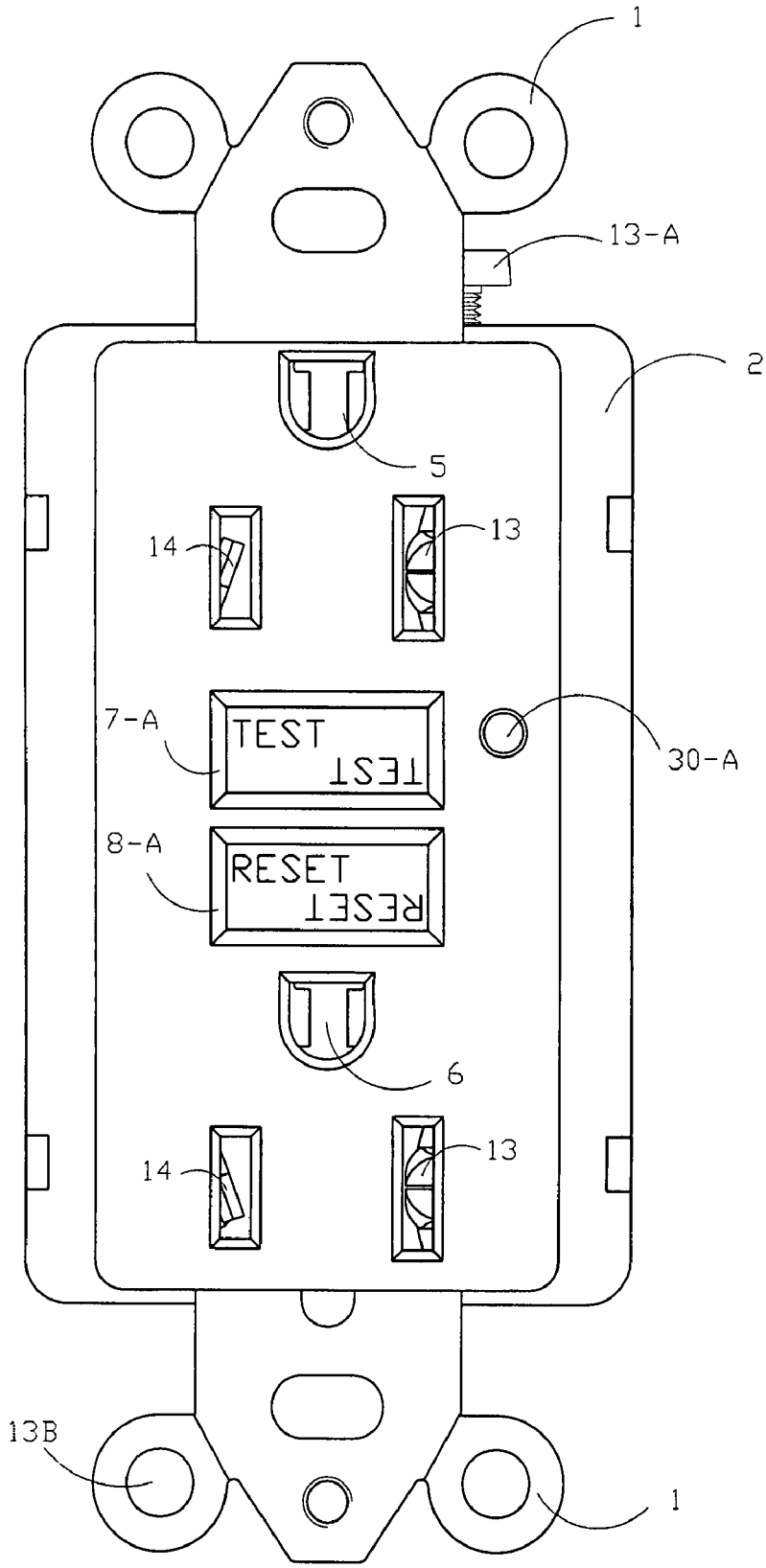
FIG. 2 is the front view of the exemplary GFCI of FIG. 1.
Figure 3:
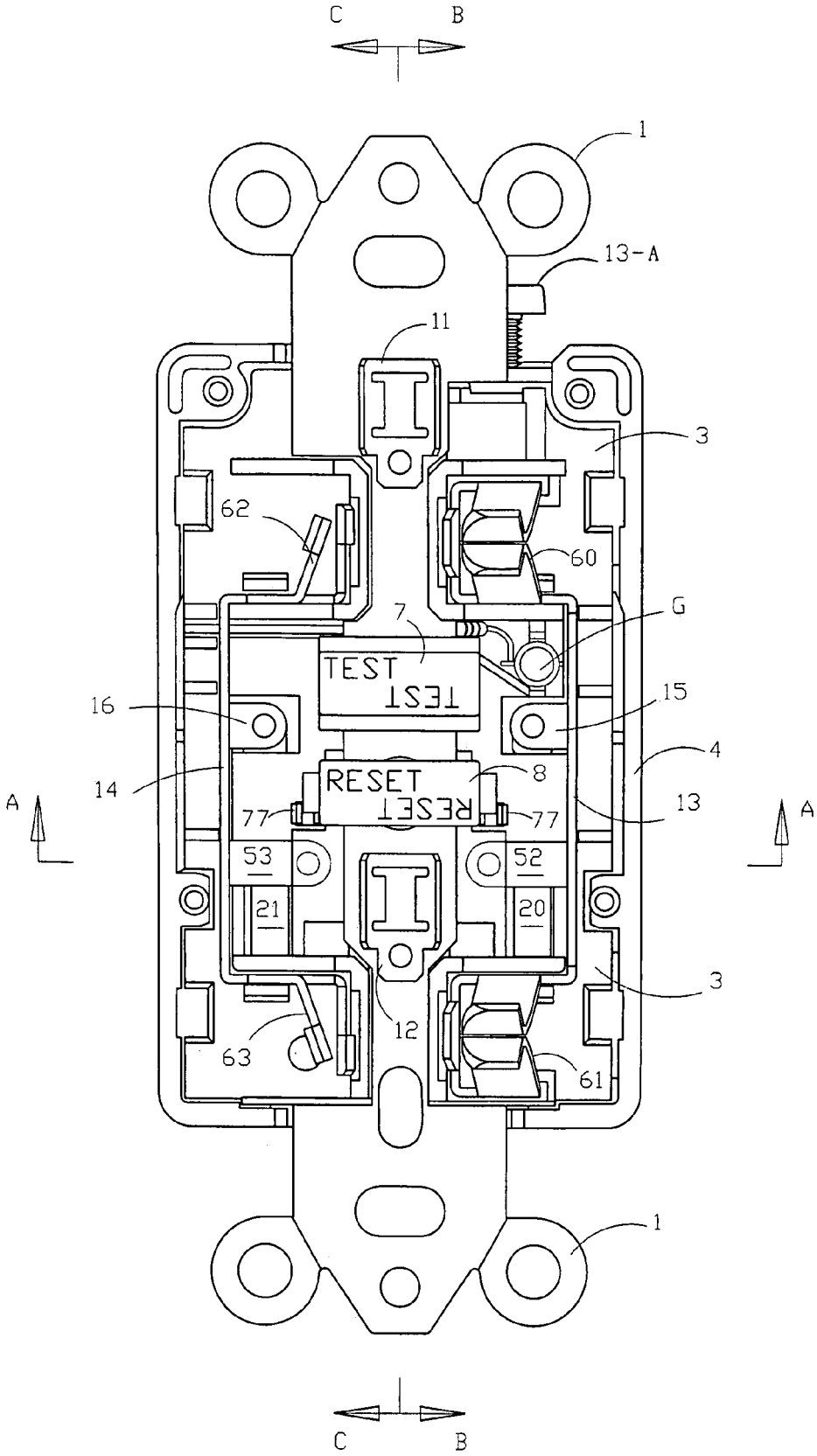
FIG. 3 is the front view of the exemplary GFCI of FIG. 1 with the upper cover removed.

FIG. 1 illustrates an exemplary circuit interrupting device, i.e., a GFCI, that provides a novel circuit and mechanism for resetting the GFCI when the reset button is pressed. Also, the GFCI provides a novel circuit and mechanism for providing GFCI status indicators and for tripping the GFCI if a fault is detected. In addition, the novel GFCI circuit and mechanism provides an end-of-life test on the GFCI. FIG. 2 is the front view of the exemplary GFCI of FIG. 1. FIG. 3 is the front view of the exemplary GFCI of FIG. 1 with the upper cover removed.

As shown in FIG. 1, the circuit interrupting device includes a housing and a circuit board 18 that is located inside the housing. The circuit board 18 is capable of sensing when the reset button is pressed and providing the status of the reset button. In addition, the circuit board 18 produces a heavy electric current to activate a solenoid coil 26 that resets the GFCI when the reset button 8 is pressed. The circuit board 18 is also capable of detecting whether the circuit interrupting device has power output, automatically performing a test on whether the circuit interrupting device has come to the end of its service life and whether the circuit interrupting device still provides protection against any leakage current, and automatically displaying the test result.

As shown in FIG. 1, the housing of the circuit interrupting device includes a front lid 2, an insulated mid-level support 3, and a base 4. A metal mounting strap 1 is installed between the front lid 2 and the insulated mid-level support 3. The circuit board 18 is installed between the insulated mid-level support 3 and the base 4.

As shown in FIG. 1 and FIG. 2, power output sockets 5, 6, a reset button hole 8-A, a test button hole 7-A, and a status indicating light hole 30-A are located on the front lid 2. A reset button (RESET) 8 and a test button (TEST) 7 are installed in the reset button hole 8-A and the test button hole 7-A, respectively. The reset button 8 and the test button 7 penetrate through the metal mounting strap 1 and the insulated mid-level support 3 to make contact with the components on the circuit board 18. Four clamp hooks 2-A are located on the side of the front lid 2 to be used for fastening a groove 4-B on the base 4.

The metal mounting strap 1 is grounded through a grounding screw 13-A (as shown in FIGS. 1-2) and wires. Grounding pieces 11, 12 are arranged on the metal mounting strap 1 at places corresponding to the grounding holes of the power output sockets 5, 6 of the front lid 2.

As shown in FIGS. 1 and 3, a hot power output conductor 14 and a neutral power output conductor 13 are installed on the two sides of the insulated mid-level support 3. At the two ends of the power output conductors 13, 14, gripping wing pieces 60, 61, 62, 63 are arranged at the places corresponding to the hot and neutral holes of the power output sockets 5, 6 on the front lid 2. Fixed contacts 15, 52 and 16, 53 are arranged on the power output conductors 13 and 14, respectively, to form two pairs of fixed contacts "15, 16" and "52, 53."

As shown in FIG. 1, the base 4 is used to accommodate the insulated mid-level support 3 and the circuit board 18. A pair of hot and neutral power input wiring screws 9, 10 and a pair of hot and neutral power output wiring screws 109, 110 are installed symmetrically on the two sides of the base 4.

The circuit board 18, which is installed inside the housing, is capable of supplying power to or cutting off power from the power output sockets 5, 6 of the front lid 2 and the power output wiring screws 109, 110. The circuit board 18 is also capable of automatically checking for component failure, setting up a corrective reset mechanism upon power-on, and preventing reverse wiring errors.

Figure 4:
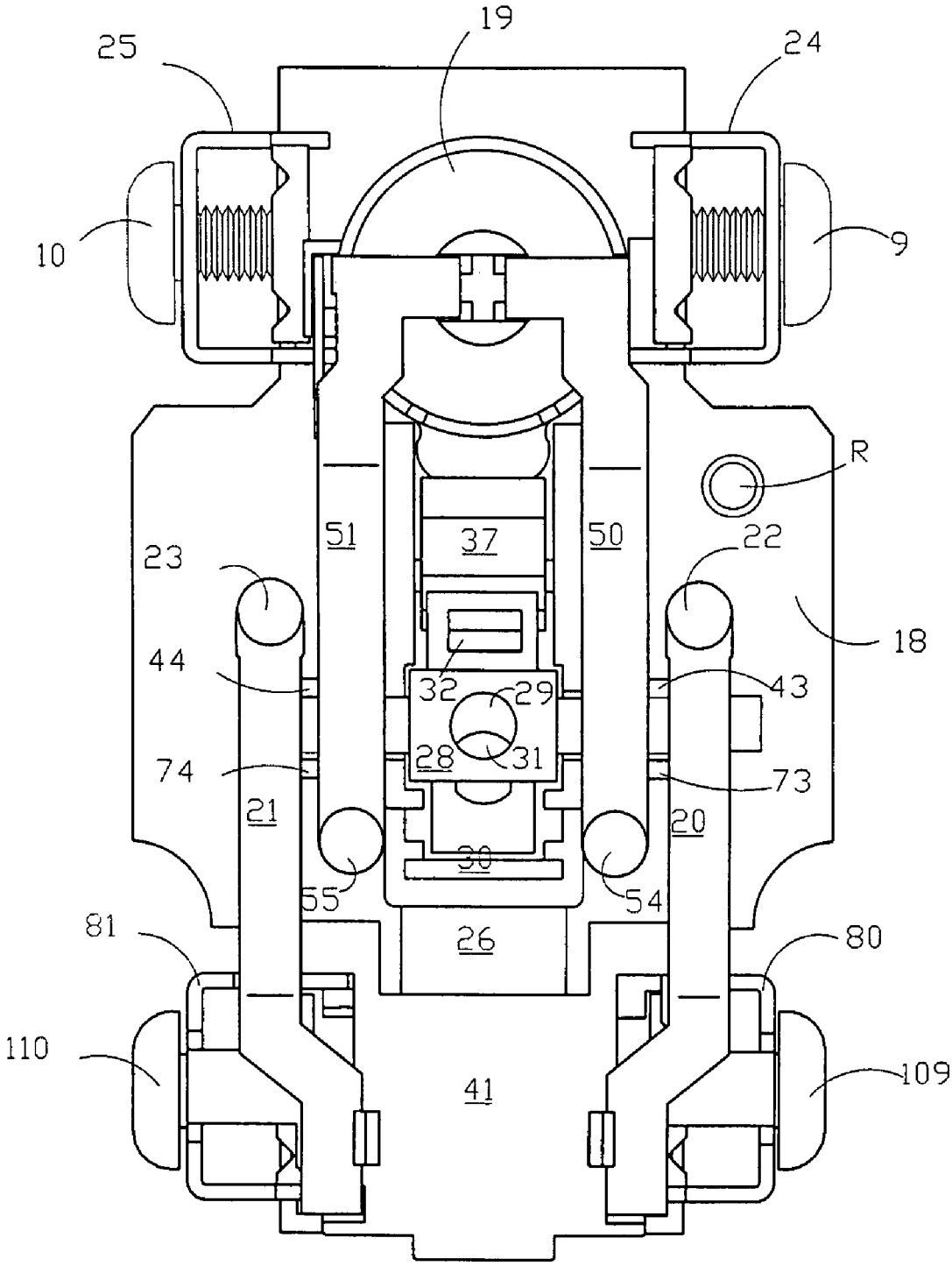
FIG. 4 illustrates exemplary relationships among the components of the printed circuit board of the exemplary GFCI of FIG. 1.

FIG. 4 illustrates exemplary relationships among the components of the circuit board 18. As shown in FIG. 1 and FIG. 4, a flexible neutral power input metal piece 50 and a flexible hot power input metal piece 51 are located on the circuit board 18. One end of the flexible neutral power input metal piece 50 is bent 90 degrees downwards and penetrates through a differential transformer 19. This end of the flexible neutral power input metal piece 50 is soldered onto the circuit board 18 and connected to the neutral power input wiring screw 9 through an input wiring piece 24. Similarly, one end of the flexible hot power input metal piece 51 is also bent 90 degrees downwards and penetrates through the differential transformer 19. This end of the flexible hot power input metal piece 51 is soldered onto the circuit board 18 and connected to the hot power input wiring screw 10 through an input wiring piece 25. The neutral power input wiring screw 9 is connected to a neutral wire inside a wall through a conductive wire. The hot power input wiring screw 10 is connected to a hot wire inside the wall through a conductive wire.

A movable contact 54 is located on the opposite end of the flexible neutral power input metal piece 50. A movable contact 55 is located on the opposite end of the flexible hot power input metal piece 51. The movable contacts 54, 55 respectively correspond to fixed contacts 52, 53 on the power output conductors 13, 14 located on the insulated mid-level support 3 (as shown in FIG. 3). Two flexible output metal pieces 20, 21 are located above and on the sides of the circuit board 18. One end of the flexible neutral output metal piece 20 is soldered onto the circuit board 18, together with the neutral power output terminal 80, and is connected to the neutral power output wiring screw 109 located on the base 4. The movable contact 22 is located on the opposite end of the flexible neutral output metal piece 20. Similarly, one end of the flexible hot output metal piece 21 is soldered onto the circuit board 18, together with the hot power output terminal 81, and is connected to the hot power output wiring screw 110 located on the base 4. The movable contact 23 is located on the opposite end of the flexible hot output metal piece 21. These movable contacts 22, 23 respectively correspond to fixed contacts 15, 16 on the neutral power output conductor 13 and the hot power output conductor 14 (as shown in FIG. 3).

Figure 9:
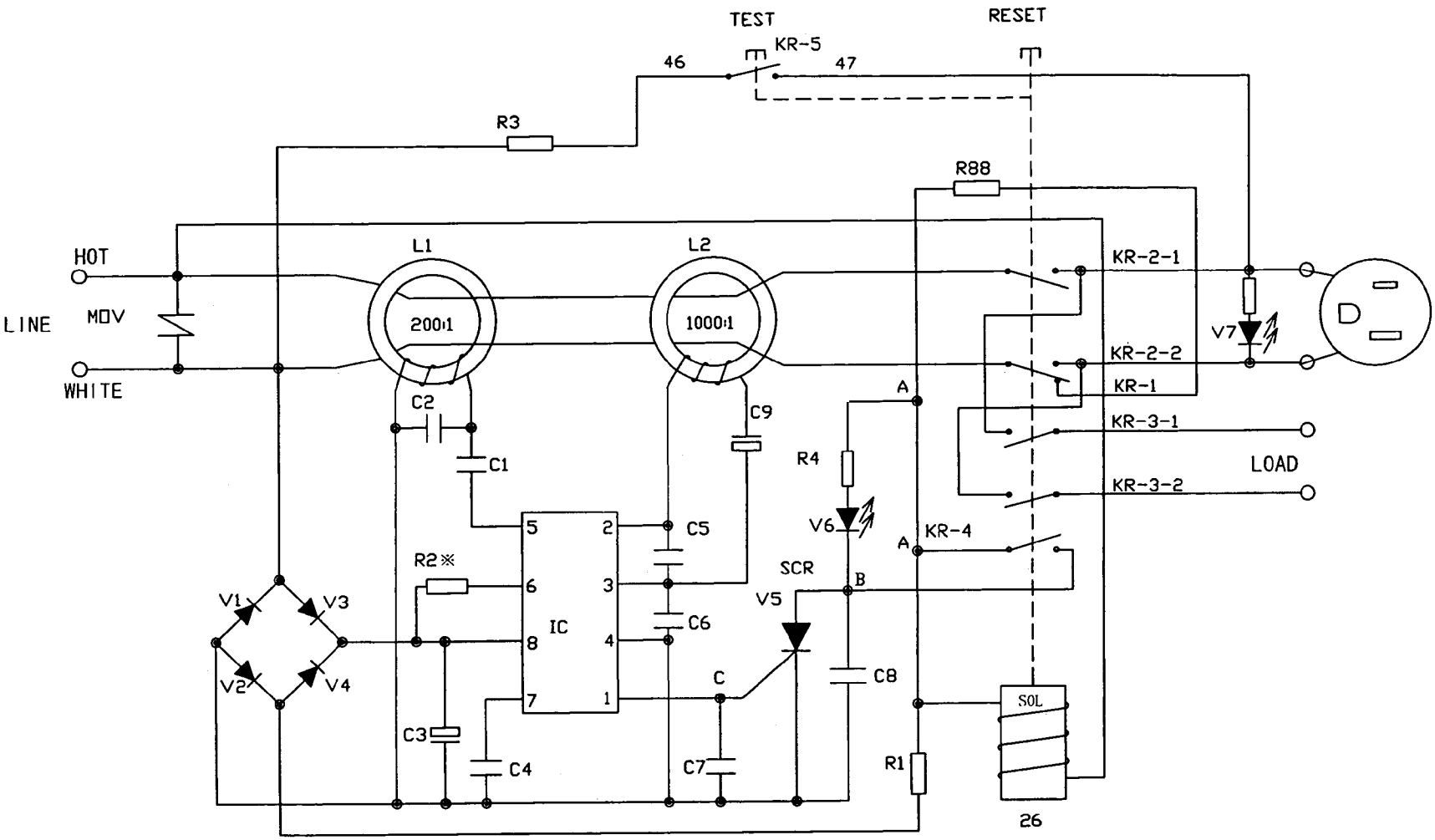
FIG. 9 is a wiring diagram of an exemplary internal circuit of the GFCI.

As shown in FIG. 9 (to be described in detail later), the movable contact 55 on the flexible hot power input metal piece 51 and the fixed contact 53 on the hot power output conductor 14 form a pair of switches KR2-1. The movable contact 54 on the flexible neutral power input metal piece 50 and the fixed contact 52 on the neutral power output conductor 13 form a pair of switches KR2-2. The fixed contact 16 on the hot power output conductor 14 and the movable contact 23 on the flexible hot output metal piece 21 form a pair of switches KR3-1. The fixed contact 15 on the neutral power output conductor 13 and the movable contact 22 on the flexible neutral output metal piece 20 form a pair of switches KR3-2. Accordingly, the movable contacts and fixed contacts on the flexible power input metal pieces 50, 51, the power output conductors 13, 14, and the flexible output metal pieces 20, 21 form two groups of four pairs of power switches, e.g., KR2-1, KR2-2, KR3-1, KR3-2.

As shown in FIG. 4 and FIG. 9, a differential transformer 19 (illustrated as differential transformers L1, L2 in FIG. 9) is located on the printed circuit board 18 to detect a leakage current on the printed circuit board 18. A hot wire ("HOT") and a neutral wire ("NEUTRAL") penetrate through the differential transformer 19. When an electrical current leakage occurs in a power supply loop, the differential transformer 19 outputs a voltage signal to a leakage detection control chip IC (e.g., model number LM1851/RC4145). Pin 1 of the leakage detection control chip IC outputs a control signal through a silicon controlled rectifier V5 to mechanically trip the devices on the printed circuit board 18 by releasing the reset button 8 so as to interrupt the power output.

Figure 5A:
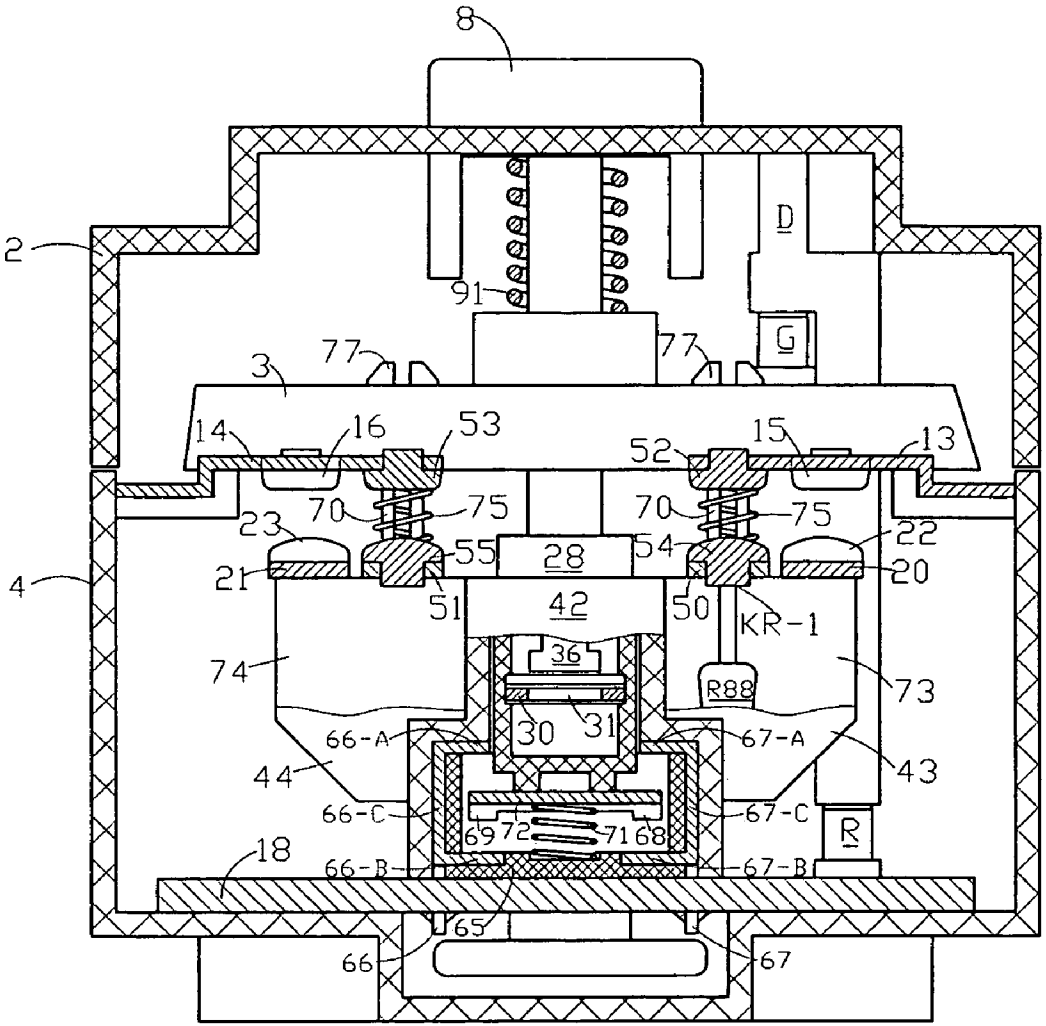
FIG. 5-A is a partial cross-sectional view along the A-A line in FIG. 3, illustrating the GFCI in an initial state without power output.
Figure 5B:
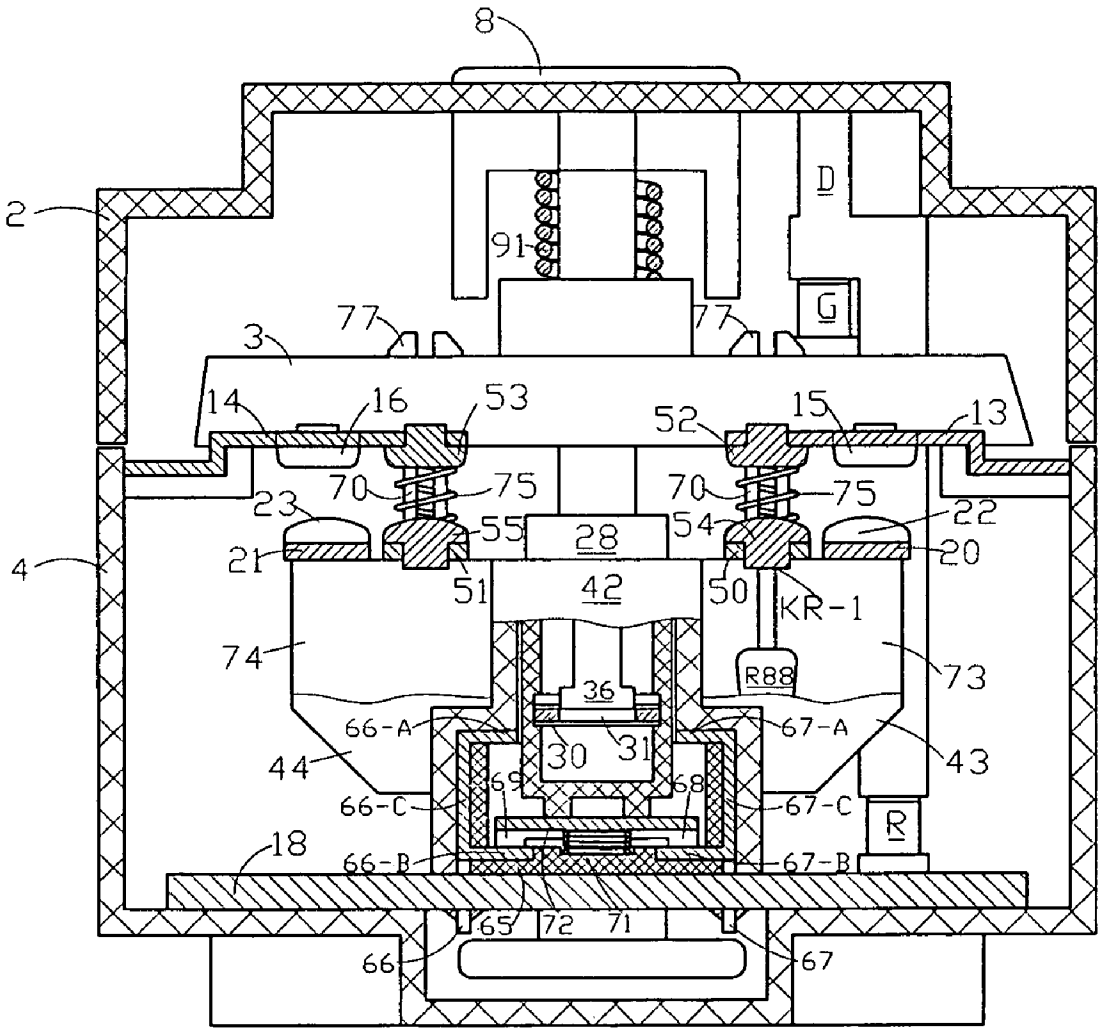
Figure 5C:
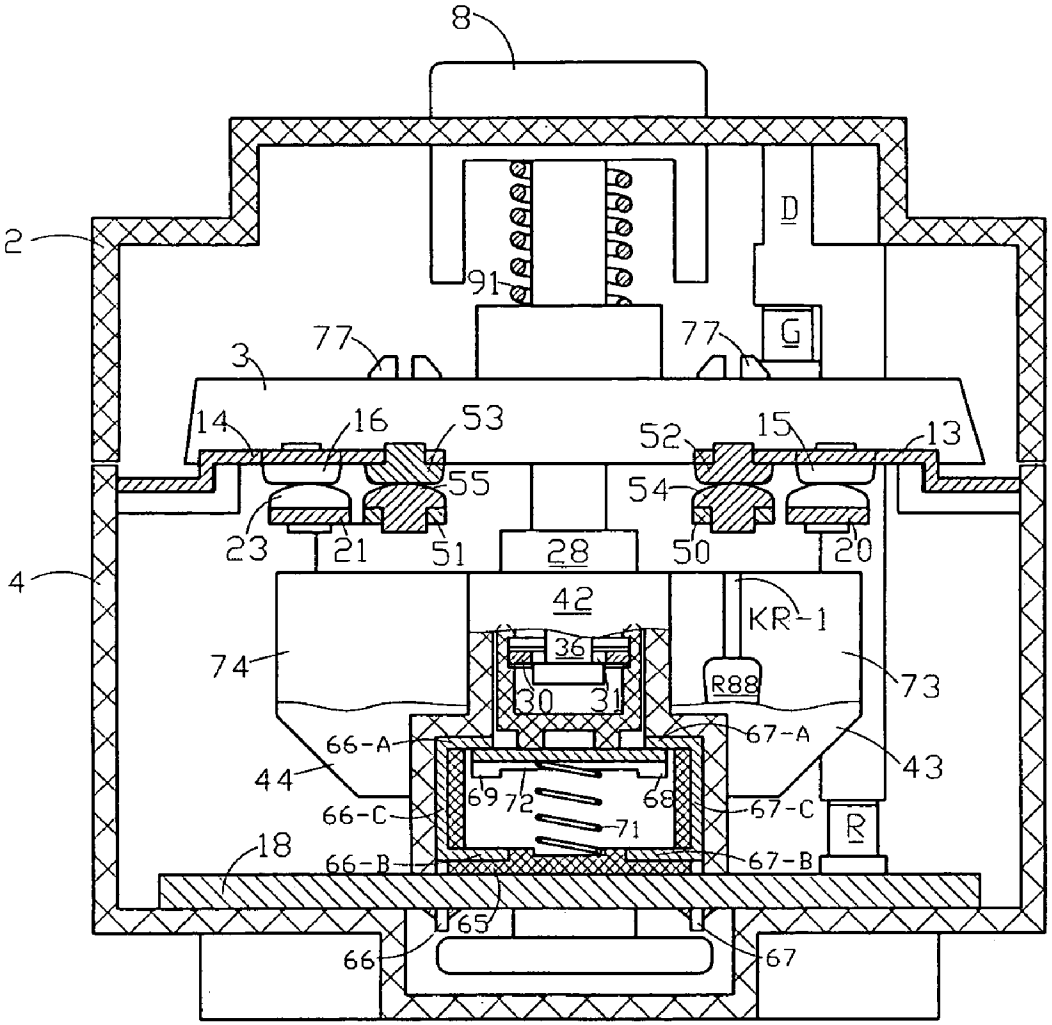

FIG. 5-A is a partial cross-sectional view along the A-A line in FIG. 3, illustrating the GFCI in an initial state without power output. FIG. 5-B is a partial cross-sectional view along the A-A line in FIG. 3, illustrating the GFCI when the reset button is initially pressed to reset the GFCI, and FIG. 5-C is a partial cross-sectional view along the A-A line in FIG. 3, illustrating the GFCI when the reset button is reset and the GFCI is in a normal state.

Figure 6A:
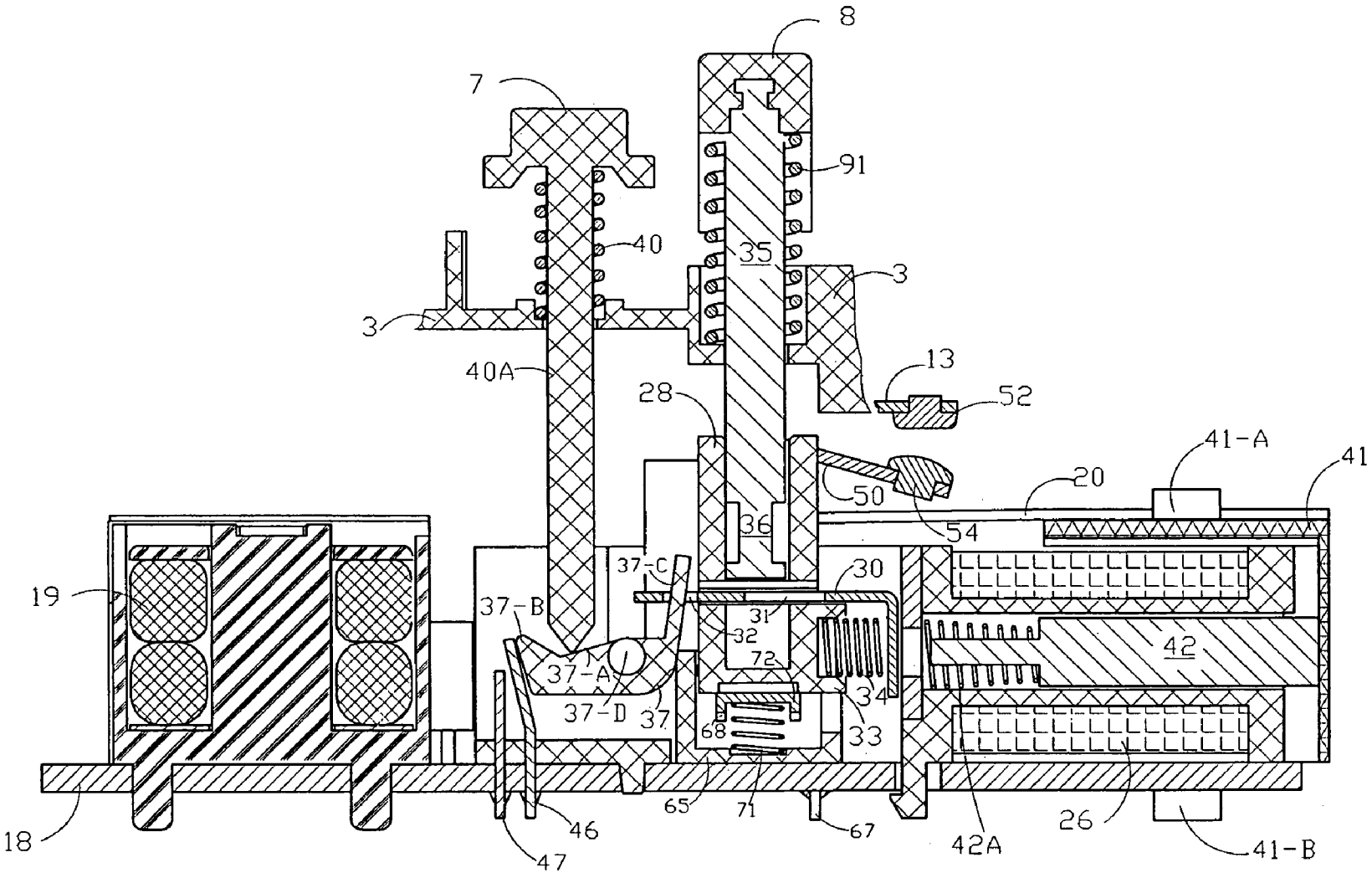
FIG. 6-A is a partial cross-sectional view along the B-B line in FIG. 3, illustrating the GFCI in an initial state without power output.
Figure 6B:
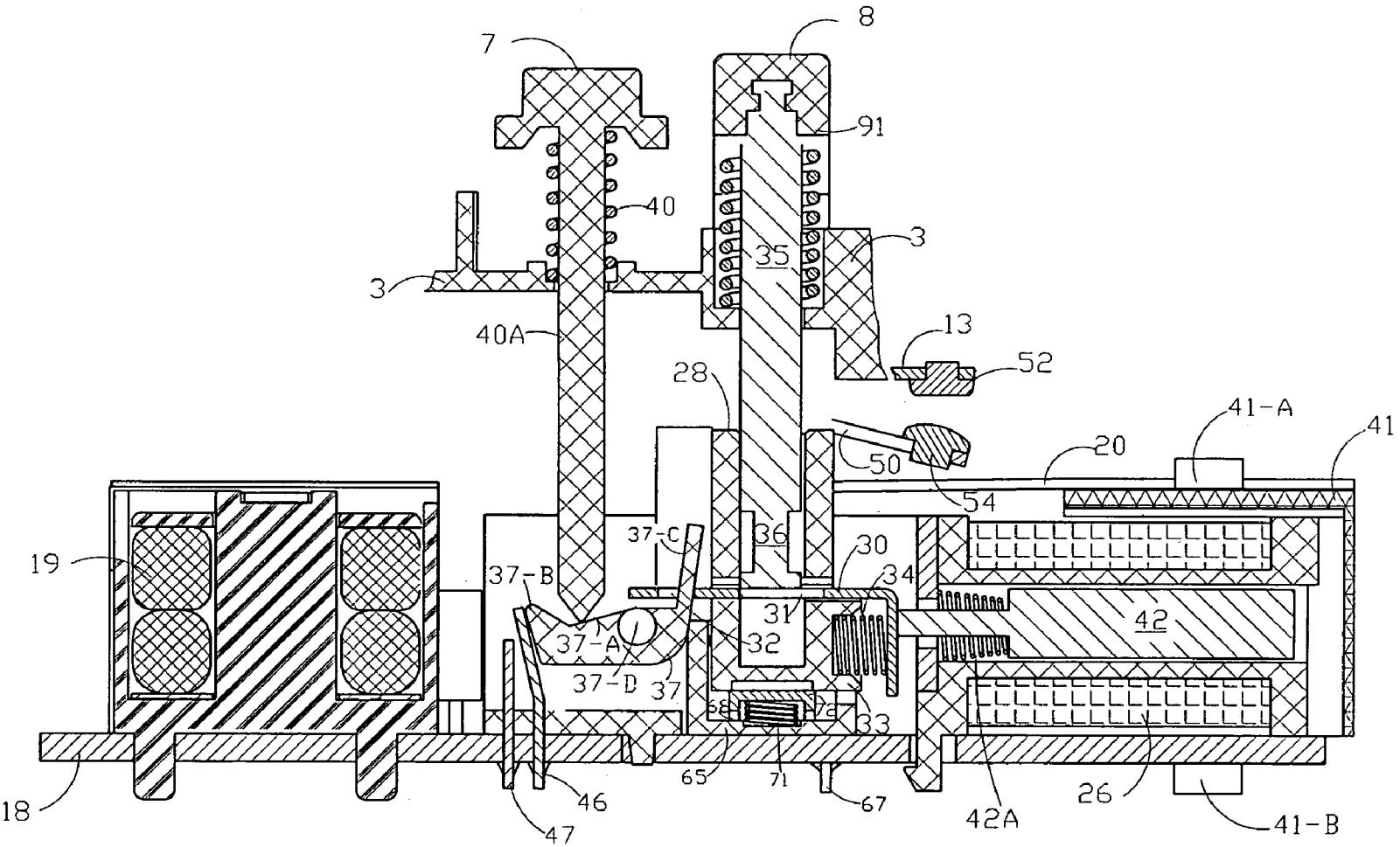
Figure 6C:
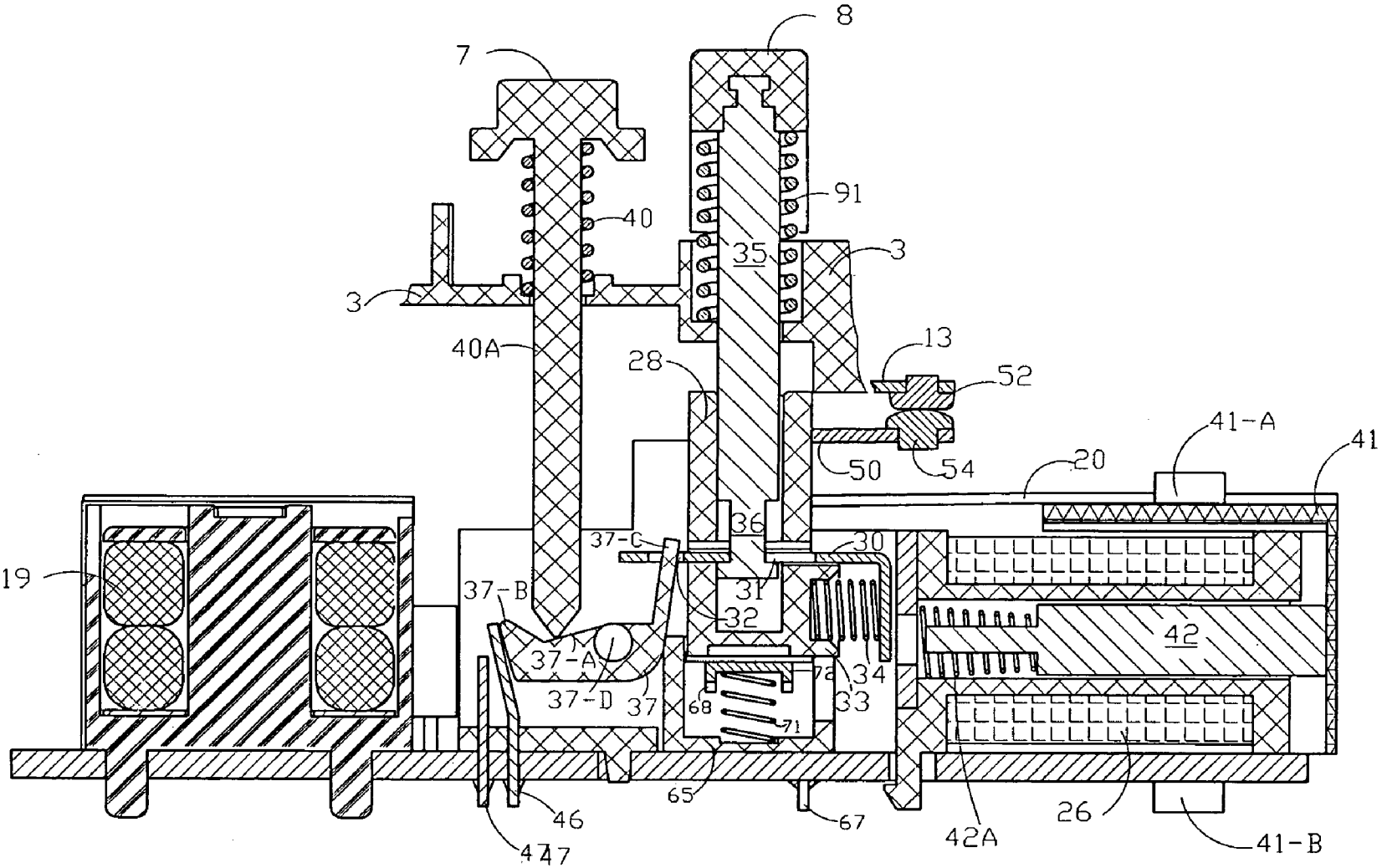
Figure 7A:
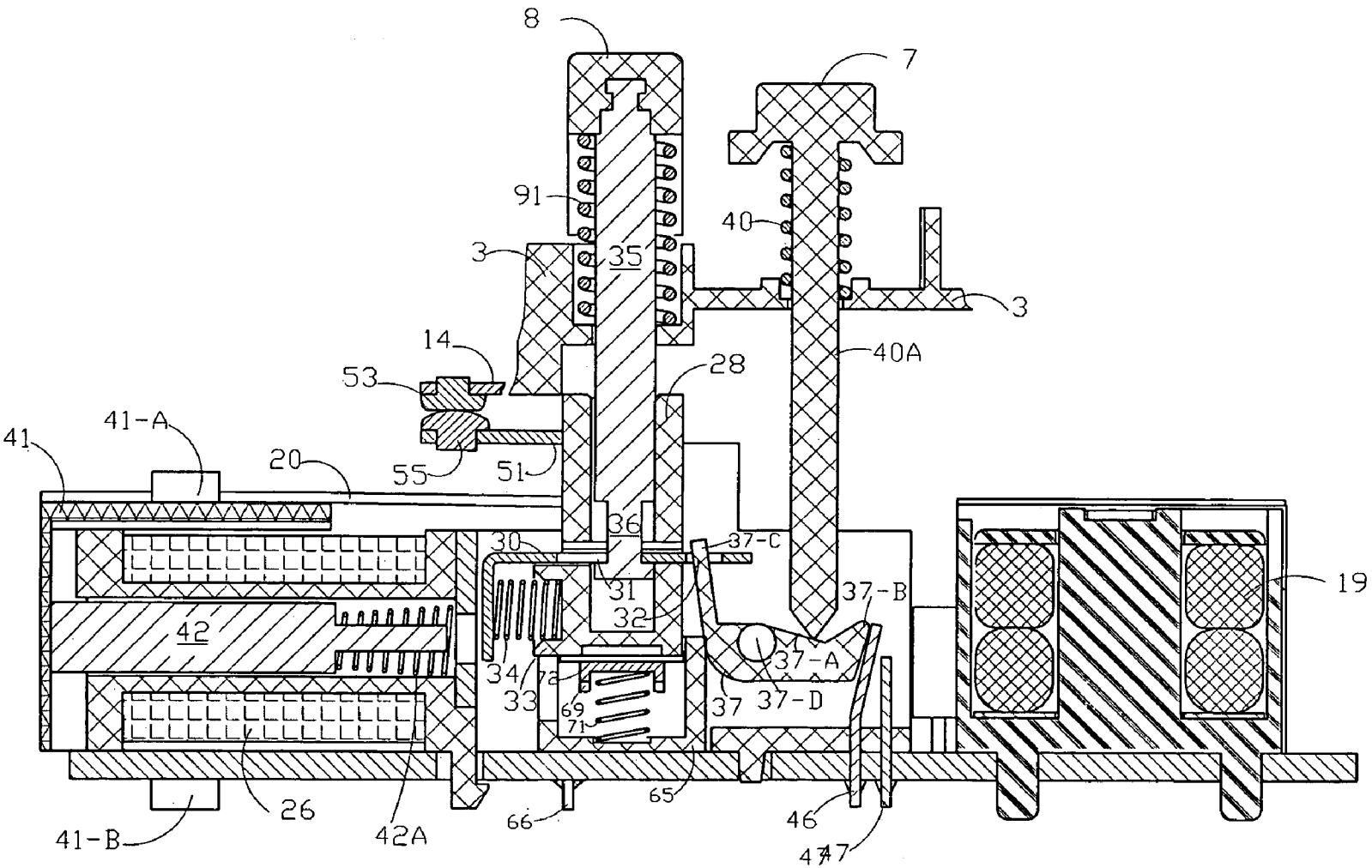
FIG. 7-A is a partial cross-sectional view along the C-C line in FIG. 3, illustrating the GFCI when it works normally with power output.
Figure 7B:
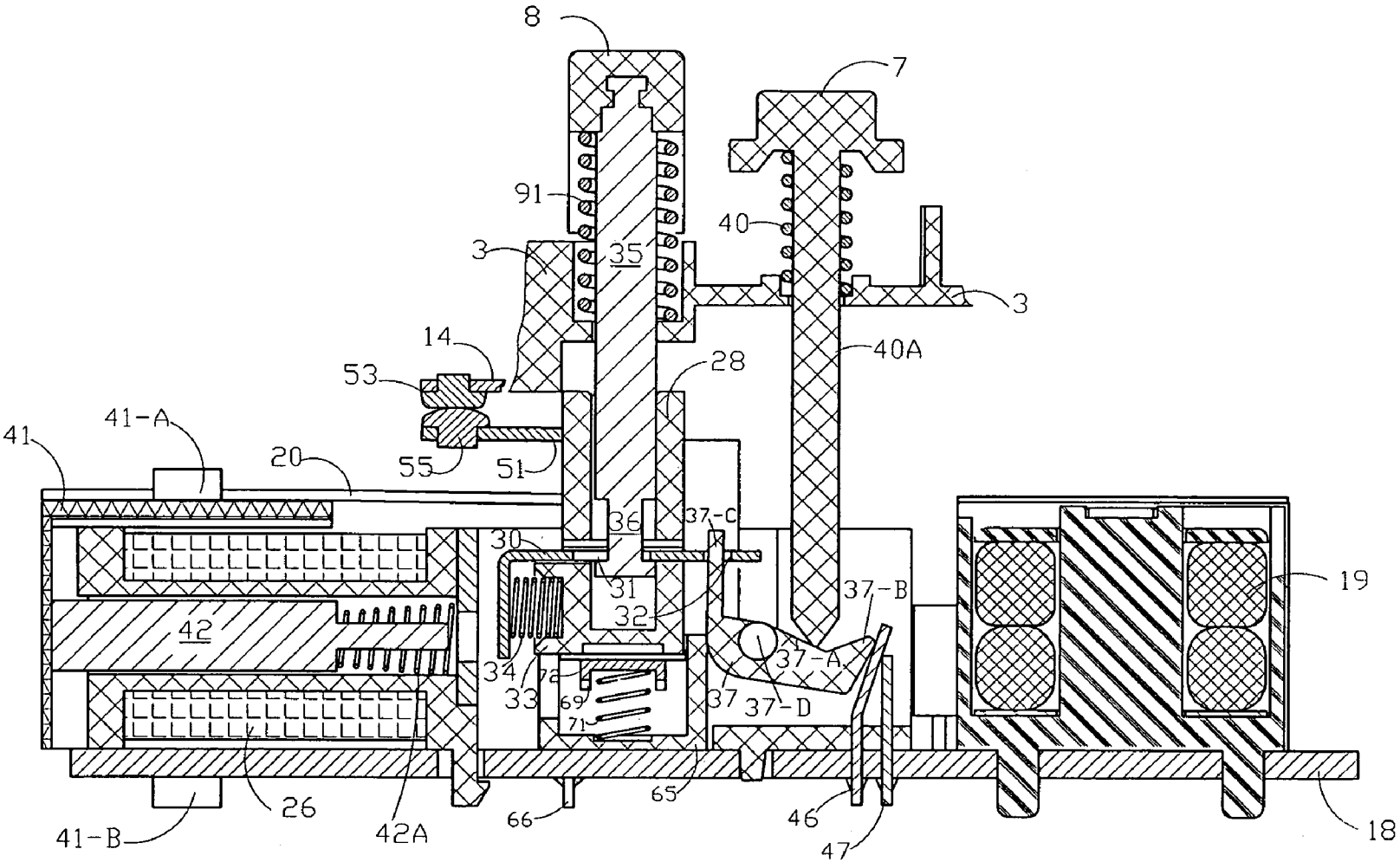
Figure 7C:
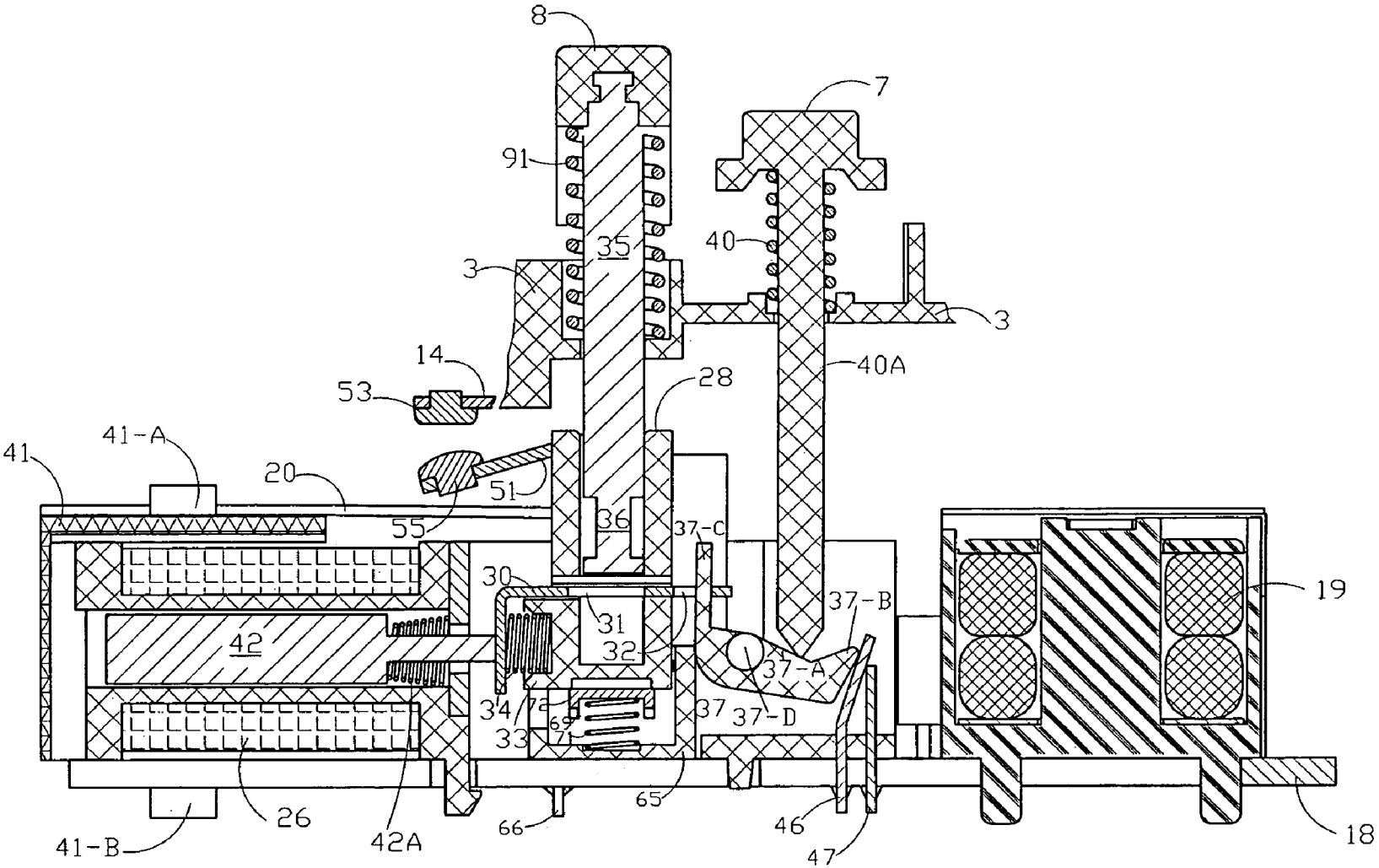
Figure 7D:
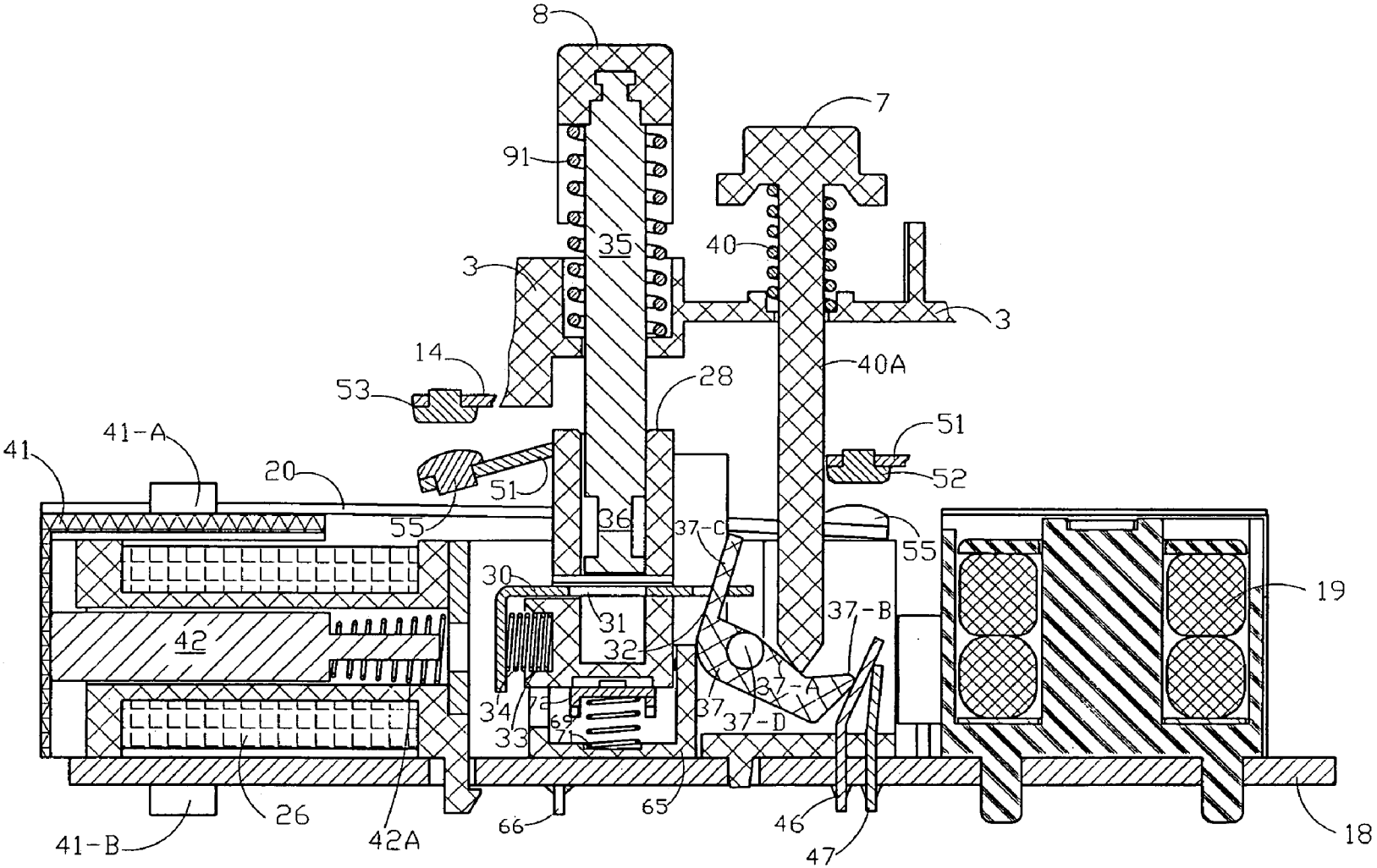

FIG. 6-A is a partial cross-sectional view along the B-B line in FIG. 3, illustrating the GFCI in an initial state without power output. FIG. 6-B is a partial cross-sectional view along the B-B line in FIG. 3, illustrating the GFCI when the reset button is initially pressed to reset the GFCI, and FIG. 6-C is a partial cross-sectional view along the B-B line in FIG. 3, illustrating the GFCI when the reset button is reset and the GFCI is in a normal state.

Figure 8:
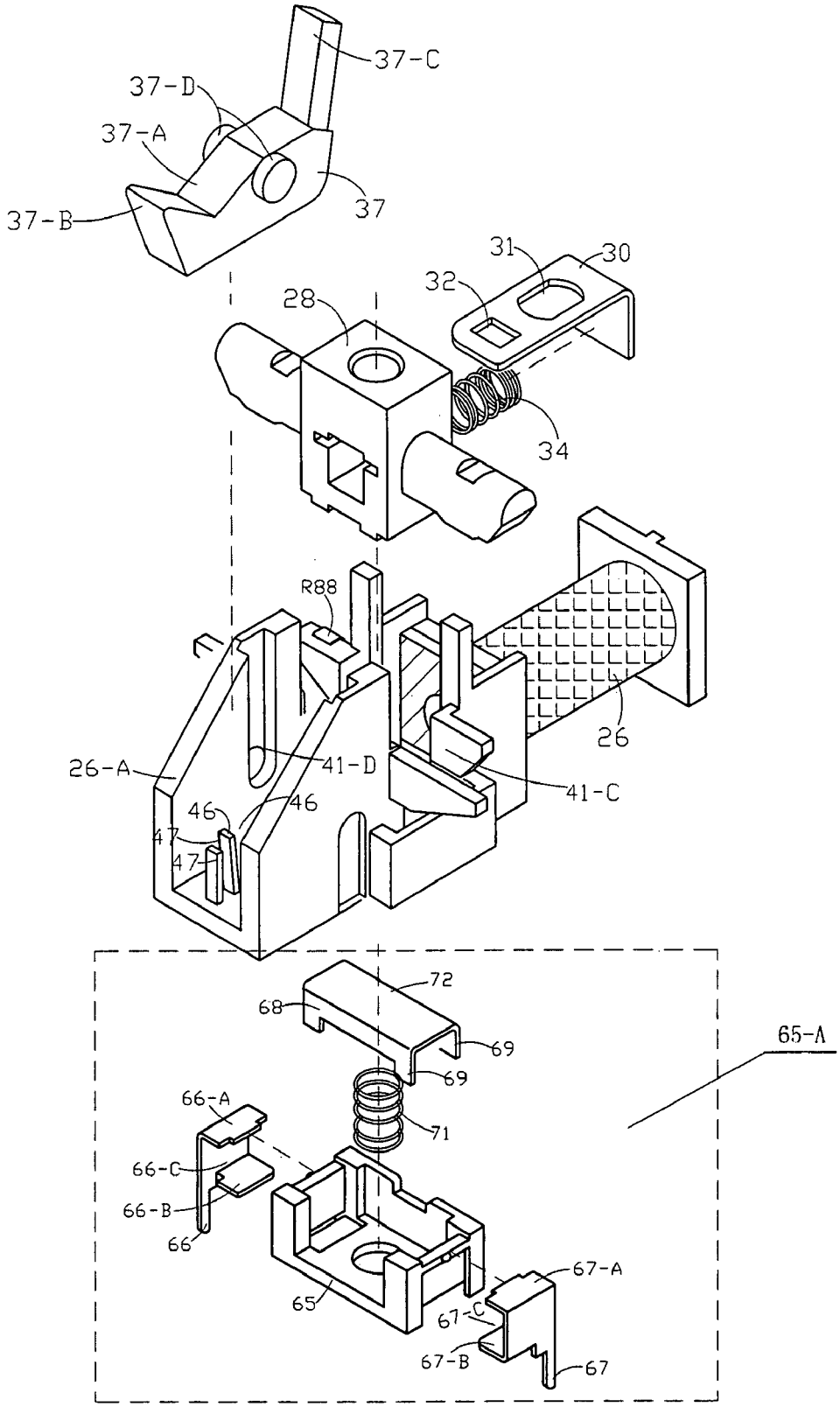
FIG. 8 is an exploded view illustrating an exemplary mechanical tripping device including a reset conducting apparatus of the GFCI of FIG. 1.

FIG. 8 illustrates a section of a tripping device including a reset conducting apparatus 65-A in accordance with an embodiment of the invention.

As shown in FIG. 1, FIG. 4, FIG. 5-A, FIG. 6-A and FIG. 8, the tripping device, which is located on the circuit board 18, may enable the flexible power input metal pieces 50, 51 and the power output conductors 13, 14 to be connected or disconnected, thus supplying power to or cutting off power from the flexible power output metal pieces 20, 21 and the power output terminals 80, 81 through the power output conductors 13, 14. The tripping device includes a tripper 28, a reset conducting apparatus 65-A, a reset directional lock 35, reset spring 91, a locking member 30, a locking spring 34, a rotatable tripping lever 37, and a solenoid coil 26, i.e., solenoid coil (SOL).

The tripper 28 may have a cylindrical body and is located below the reset button 8. The left side and the right side of the tripper 28 extend outwardly to form lifting arms. The flexible power input metal pieces 50, 51 and the flexible power output metal pieces 20, 21 are located on the upper part of the lifting arms on both sides of the tripper 28 and can move up and down with the tripper 28. As shown in FIG. 4, the movable contact 54 on the flexible neutral power input metal piece 50 and the movable contact 22 on the flexible neutral output metal piece 20 cross each other at a position above the side lifting arm of the tripper 28. Similarly, the movable contact 55 on the flexible hot power input metal piece 51 and the movable contact 23 on the flexible hot output metal piece 21 cross each other at a position above the side lifting arm of the tripper 28.

As shown in FIG. 4 and FIG. 6-A, a longitudinal central through hole 29 is formed on top of the tripper 28 and is embedded in a reset directional lock 35, which is equipped with a reset spring 91 and embedded at the bottom of the reset button 8. The reset directional lock 35 has a blunt end and is movable in a vertical direction in the central through hole 29.

A circular recessed locking slot 36 is formed in the lower part of the reset directional lock 35 close to the bottom of the reset directional lock 35 to form a groove. A movable "L"-shaped locking member 30 made of a metal material is arranged in the lower part of tripper 28 and penetrates through the tripper 28. A through hole 31 is formed on the horizontal side of the locking member 30. The locking member 30 is movable in a horizontal direction between an aligned position (in which the through hole 31 of the locking member 30 is aligned with the blunt end of the rest directional lock 35 to allow the rest directional lock 35 to pass through) and a misaligned position (in which the circular recess locking slot 36 of the directional lock 35 is locked into the through hole 31 of the locking member 30). A circular slot 33 is formed between the side wall of tripper 28 and the inner side of the locking member 30. The locking spring 34 is arranged in the circular slot 33. The solenoid coil 26 with a built-in movable iron core 42 is arranged outside of the side wall of the locking member 30. The movable iron core 42 inside the solenoid coil 26 faces the side wall of the locking member 30. Locking member 30 can move when forced by iron core 42, causing reset button 8 to reset or release (trip). A spring 42A is inserted on a section of iron core 42, as shown. A protective shield 41 is arranged above the solenoid coil 26. One end of the insulated mid-level support 3 presses against the protective shield 41.

As shown in FIG. 5-A, FIG. 6-A and FIG. 8, a reset conducting apparatus 65-A is positioned under tripper 28 and reflects the status of reset button 8, which is operatively coupled to the reset conducting apparatus as shown. The reset conducting apparatus 65-A includes reset switch box 65, two "F" shaped conducting pins 66 and 67, conducting bridge 72 and directional spring 71.

The two "F" shaped conducting pins 66 and 67 may be positioned on opposite sides of the reset switch box 65. The "F" shaped pins 66 and 67 comprise upper conducting pieces 66-A and 67-A, center recessed slots 66-C and 67-C, and lower conducting pieces 66-B and 67-C. A lower end of one of the "F" shaped conducting pin 67 is connected to the grounding power line through a silicon controlled rectifier V5. The lower end of the other "F" shaped conducting pin 66 is connected to the hot power line of the alternating power input end through solenoid coil 26 (as shown in FIG. 9).

The reset conducting apparatus 65-A also includes a conducting bridge 72, which is positioned within the reset switch box 65. The conducting bridge 72 may be positioned between the recessed slots 66-C and 67-C of the two "F" shaped conducting pins 66 and 67. The conducting bridge 72 includes a first pair of contact legs 68 and a second pair of contact legs 69 extending from the conducting bridge 72. The conducting bridge 72 may rest on a directional spring 71 positioned inside the reset switch box 65, in a circular plate slot used to fix directional spring 71. As shown in FIG. 5A, the reset button 8 is operatively coupled to conducting bridge 72, which couples to tripper 28 move from middle, lower or upper positions on directional spring 71 with the tripper 28, reflecting the status of the reset button 8. In the middle position, when the reset button 8 and tripper 28 are in the release state, the conducting bridge 72 rests within sections 66-C and 67-C of conducting pins 66 and 67 without touching the pins 66 and 67, as shown in FIG. 5A. If the reset button 8 is pressed, the first pair of contact legs 68 and the second pair of contact legs 69 of conducting bridge 72, come into contact with lower horizontal portions 66-B and 67-B of pins 66 and 67, respectively. As described below, when the conducting bridge 72 contacts lower horizontal portions 66-B and 67-B, the solenoid 26 is activated causing the GFCI to reset and conducting bridge 72 contacts upper horizontal portions 66-A and 67-A of pins 66 and 67, respectively. Thus, the conducting bridge 72. under the action of directional spring 71 and tripper 28, moves from a stationary to a reset position, reflecting the status of reset button 8.

The reset conducting apparatus 65-A constitutes a reset start switch KR-4, shown in FIG. 9, coupled to the tripper 28 and that reflects the status of reset button 8. As shown in FIG. 5-A, FIG. 6-A and FIG. 9, when reset button 8 is in a released state, conducting bridge 72 is in its middle position just inside recessed slots 66-C and 67-C of "F" shaped conducting pins 66 and 67 and the reset start switch KR-4 is in a disconnected state.

As shown in FIG. 5-2, FIG. 6-2 and FIG. 9, when reset button 8 is pressed, tripper 28 is pressed and moves downward, pressing conducting bridge 72 to move to a lower position on directional spring 71. The contact legs 68 and 69 of the conducting bridge 72 comes into contact with lower horizontal portions 66-B and 67-B of "F" shaped conducting pins 66 and 67, respectively, and the reset start switch KR-4 is in a closed state.

As shown in FIG. 5-3, FIG. 6-3 and FIG. 9, when locking slot 36 at the bottom of reset directional lock 35 is inside lock hole 31 of lock 30, reset directional lock 35 moves up and causes reset spring 91 to be released, pulling tripper 28 to move up at the same time. Under the action of directional spring 71, conducting bridge 72 also moves up therewith, so that contact legs 68 and 69 of conducting bridge 72 come into contact upper conducting pieces 66-A and 67-A of "F" shaped conducting pin 66 and 67, respectively and the reset start switch KR-4 is in a closed state.

Therefore, the present invention indicates the status of reset button 8 through the reset conducting apparatus 65-A (i.e., reset start switch KR-4). When contact legs 68 and 69 on the two sides of conducting bridge 72 formed by the sides bending downward respectively are in recessed slot 66-C and 67-C between conducting pins 66 and 67, when reset button 8 is in a released state. When contact legs 68 and 69 on the two sides of conducting bridge 72 formed by the sides bending downward respectively come into contact with lower conducting pieces 66-B and 67-B of reset conducting pins 66 and 67 and become on, which demonstrates that reset button 8 is pressed. When the upper surfaces of contact legs 68 and 69 on the two sides of conducting bridge 72 come into contact with upper conducting pieces 66-A and 67-A of conducting pins 66 and 67 and become on, reset button 8 is in a reset state.

As shown in FIG. 5-A and FIG. 9, the present invention places a simulated leakage current controlling resistor R88 directly under flexible neutral power line input metal piece 50. One end of the resistor directly faces flexible neutral power line input metal piece 50, while the other end is connected to the hot power line of the power input end of the circuit board through solenoid coil 26. Flexible neutral power line input metal piece 50, and simulated leakage current controlling resistor R88 form a leakage current simulation switch, coupled to reset button 8, such as switch KR-1 in FIG. 9. When the GFCI is in an initial state, the flexible neutral power line input metal piece 50 comes into contact with the simulated leakage current controlling resistor R88, closing switch KR-1. After the GFCI is reset, the flexible neutral power line input metal piece 50 is disconnected from the simulated leakage current controlling resistor R88, opening switch KR1.

As long as the power input end hot power line 51 and neutral power line 50 of the GFCI are properly connected to the hot power line and the neutral power line inside the wall, the power input end neutral power line 50 is connected to the hot power line 51 on the circuit board 18 through flexible neutral power line input metal piece 50, simulated leakage current controlling resistor R88, and the solenoid coil 26, forming a loop capable of automatically generating simulated leakage current without the need to operate any part.

As shown in FIG. 6-A and FIG. 8, the rotatable spoon shaped rotatable tripping lever 37 is arranged directly below the test button 7. The rotatable tripping lever 37 is fastened in a directional slot 41-D in the front end of the solenoid coil using a lever axis 37-D. The rotatable tripping lever 37 can rotate around the lever axis 37-D. Small V shaped slots 37-A and 37-B are arranged on the horizontal side of the spoon shaped rotatable tripping lever 37. The downwardly extended pointed tip of the test button's arm 40A, in which a slipped over spring 40 penetrates, is arranged inside the V shaped slots 37-A and 37-B. By pressing the test button 7, its downwardly extended arm 40A causes the rotatable tripping lever 37 to rotate around the lever axis 37-D by pushing against the V shaped slots 37-A and 37-B. The upwardly inclined handle 37-C of the spoon shaped rotatable tripping lever 37 penetrates through the hole 32 at the top of the locking member 30 near the test button 7. A pair of spring pieces 46 and 47 are arranged on the opposite side of the upwardly inclined handle 37-C of the spoon shaped rotatable tripping lever 37.

The upper ends of the spring pieces 46 and 47 are open. When the test button 7 is not pressed, since the rotatable tripping lever 37 is not rotating, the upper ends of the spring pieces 46 and 47 do not come into contact. The lower end of the spring piece 46 is soldered onto the printed circuit board 18 and is connected to the neutral wire of the power input end through a resistor (R3 in FIG. 9). The lower end of the spring piece 47 is also soldered onto the printed circuit board 18 and is connected to the hot wire of the power output end. Spring pieces 46 and 47 form switch KR-5 that manually generates a simulated leakage current (as described below with respect to FIG. 9).

As shown in FIG. 6-A and FIG. 8, spring pieces 46 and 47, the rotatable tripping lever 37, and the tripper 28 are arranged at the front end of the solenoid coil. The spring pieces 46 and 47 penetrate through the solenoid coil support soldering on the printed circuit board 18. The rotatable tripping lever 37 is arranged inside the directional slot 41-D between the spring pieces and the directional base 41-C. The tripper 28 is arranged inside the directional base 41-C.

The tripper 28, the locking member 30, the locking spring 34, the rotatable tripping lever 37, and the reset start switch KR-4 are connected to each other to form an integral body that can move freely.

As shown in FIG. 1, FIG. 4, and FIG. 6-A, a coil protection cover 41 is arranged outside of the solenoid coil 26. A pair of lock hooks 41-A and 41-B are arranged on the top and bottom surfaces of the coil protection cover 41, respectively. The coil protection cover 41 is fastened onto the printed circuit board 18 through the lock hooks 41-B on the bottom surface. One end of each of the flexible output metal pieces 20, 21 that does not have a movable contact is fastened onto the coil protection cover 41 through the lock hooks 41-A on top of the coil protection cover 41 and are in close contact with the power output ends 80, 81. When the GFCI is assembled, one end of the mid-level support 3 presses down on the coil protection cover 41.

As shown in FIG. 1 and FIG. 5-A, a pair of hooked pins 70 are connected above flexible power input metal pieces 50 and 51 and are attached to mid-level support 3. A cylindrical platform 76 is arranged at the lower part of hooked pins 70. A spring 75 is inserted around the hooked pins 70. The cylindrical platform 76 is pressed onto flexible power input metal pieces 50 and 51 connected to the power input end. Hooked pins 70 begin to fork from its middle section and end at a forked protruding hook 77, shown in FIG. 5-A. The forked protruding hook 77 clamps the hooked pins 70 to mid-level support 3. The spring around hooked pins 70 and arranged between the mid-level support 3 and flexible neutral power input metal piece 50, causes the metal piece 50 to contact the simulated leakage current controlling resistor R88, generating a simulated leakage current, when the GFCI is not in a reset state.

When reset button 8 is in a released state, as long as power input end wiring screws 9 and 10 of the ground fault circuit interrupter are properly connected to the neutral power line and hot power line inside the wall, the end of simulated leakage current controlling resistor R88 will come into contact with flexible neutral power input metal piece 50 and leakage current simulation switch KR-1 is closed. The power input end neutral power line is connected to the hot power line through flexible neutral power line input metal piece 50, simulated leakage current controlling resistor R88 and solenoid coil 26, forming a loop capable of automatically generating simulated leakage current without the need to operate any part. When reset button 8 is in a released state, conducting bridge 72 is in recessed slot positions 66-C and 67-C in the middle of conducting pin 66 and 67 (as shown in FIG. 5-1). Thus, reset start switch KR-4 comprising reset conducting apparatus 65-A is in a disconnected state. When the reset button 8 is pressed, conducting bridge 72 comes into contact with lower conducting pieces 66-B and 67-B of conducting pins 66 and 67 and reset start switch KR-4 is in a closed state. Since tripper 28 moves down, neutral power line input metal piece 50 is located above the side cantilever of the tripper 28 and remains in its original position. Consequently, Neutral power line input metal piece 50 remains in a contact with resistor R88 and leakage current simulation switch KR-1 remains in a closed state. After the lock slot 36 at the bottom of reset directional lock 35 is inside lock hole 31 of lock 30, the release of the reset button causes reset directional lock 35 to move up and pulls the tripper 28 up, causing neutral power line input metal piece 50 located on the side cantilever of tripper 28 to be pulled up. As the neutral power line input metal piece 50 moves up, metal piece 50 is separated and disconnected from resistor R88 and leakage current simulation switch KR-1 is disconnected. Moving contact 54 on neutral power line input metal piece 50 come into contact with fixed contact 52 on neutral power line output conductor 13. At this time, conducting bridge 72 comes into contact with upper conducting pieces 66-A and 67-A of conducting pins 66 and 67 (as shown in FIG. 5-3) and reset start switch KR-4 (i.e., reset conducting apparatus 65-A) remains in a closed state.

FIG. 9 is a wiring diagram of the control circuit of the GFCI. As shown in the figures, the main components of the exemplary control circuit include differential transformers L1 (200:1) and L2 (1000:1) used for detecting leakage, the leakage detection control chip IC (LM1851/RC4145), the solenoid coil 26 with a built-in plunger, the silicon controlled rectifier V5, the status test switch KR-1, serially connected switches KR-2-1, KR-2-2, KR-3-1, KR-3-2, the reset start switch KR-4 coupled to the reset button, a reset indicating light V6, a power output indicator V7, the current limiting resistor R88, and some relevant diodes, resistors and capacitors.

The hot wire and neutral wire on the power supply line for the GFCI penetrate through the differential transformers L1 and L2. The signal output ends of the differential transformers L1 and L2 are connected to the signal input ends 2, 3 and 5 of the leakage detection control chip IC (LM1851) or the signal input ends 1, 2, 3, 7 of the leakage detection control chip IC (RC4145). The control signal output pin 1 of the leakage detection control chip IC (LM1851) or the control signal output pin 5 of the leakage detection control chip IC (RC4145) is connected to the gate of the silicon controlled rectifier V5. The negative pole of the silicon controlled rectifier V5 is connected to the negative pole of the direct current power supply, and the positive pole of the silicon controlled rectifier V5 is connected to the hot wire through the reset start switch KR-4 coupled to the reset button and the solenoid coil 26. The built-in plunger of the solenoid coil causes the reset button to reset or release through a mechanical tripping device, thus causing the switches KR-2-1, KR-2-2, KR-3-1, KR-3-2 coupled to the reset button to close or disconnect, respectively.

The power output indicator V7 is connected between the hot wire and the neutral wire of the power output ends of the GFCI. The reset indicating light V6 is serially connected to the silicon controlled rectifier V5.

The output indicator V7 turns "on" when the GFCI has output power output. Otherwise, output indicator V7 does not turn "on."

Reset indicating light V6 is serially connected on the loop of silicon controlled rectifier V5. One end of reset indicating light V6 is connected to the negative direct current power supply through silicon controlled rectifier V5, and the other end is connected to the hot power line of the power input end through resistor R4 and solenoid coil 26. When the leakage current protection circuit works normally, and components that comprise the leakage current protection circuit, such as silicon controlled rectifier V5, solenoid coil 26 and differential transformers L1 and L2 are intact and silicon controlled rectifier V5 is intact and can come on normally, reset indicating light V6 turns "on," indicating that the ground fault circuit interrupter has protective functions against a leakage current. In contrast, in the event that components of the leakage current protection circuit fail, causing the leakage protection circuit to come to the end of its life, reset indicating light V6 is not turned "on," indicating that the leakage protection circuit has come to the end of its life and remaining the user that it is time to promptly replace it with a new product.

The power input end neutral line penetrates through detection coils L1 (200:1) and L2 (1000:1) and is connected to the power input end hot line through the status test switch KR-1, the current limiting resistor R88, and the solenoid coil 26, forming a simulated leakage current loop. This circuit makes it possible for the power input end of the GFCI to automatically generate a simulated leakage current after it is properly connected to the power line inside the wall.

After the power input end of the GFCI is properly connected to the power line inside the wall and when the reset button is not depressed, since the status test switch KR-1 is in a closed state, the aforementioned simulated leakage current loop circuit automatically generates a simulated leakage current. As shown in FIG. 9, the simulated leakage current flows through the detection coil L2 (1000:1), which detects a voltage signal. The voltage signal is input into the signal input ends 2, 3 of the leakage detection control chip IC through a capacitor C9. The voltage signal is fed back and output to pins 5, 4 (public pole) through the leakage detection control chip IC, and then fed to the detection coil L2 (1000:1) through capacitors C1, C2 and the detection coil L1 (200:1). The voltage signal is sent back by the capacitor C9 to the signal input ends 3, 2 of the leakage detection control chip IC. After the voltage signal is amplified, a high electric level control signal is output from pin 1 of the leakage detection control chip IC to the gate of the silicon controlled rectifier V5.

The silicon controlled rectifier V5 is triggered, and the positive pole and the negative pole are turned on. The reset indicating light V6 connected on the indicator circuit between A and B emits light, indicating that the functions of the GFCI are intact and have protective functions against electric leakage current, and that the reset button can be reset. In contrast, if the GFCI has come to the end of its life, then the reset indicating light V6 will never emit any light. The silicon controlled rectifier V5 will not come on and no electric current will ever flow through the solenoid coil 26, rendering it unable to generate a magnetic field. The internal plunger inside the solenoid coil 26 does not move and the mechanical tripping device will not move. The reset button cannot be reset, thus reminding the user that the GFCI has come to the end of its life and should be replaced with a new GFCI. Therefore, after the power input end is properly connected to the power line inside the wall, the GFCI automatically performs a test on the GFCI to ascertain whether the GFCI still has any protective functions against electric leakage current, i.e., whether it has come to the end of its life. The test result is automatically displayed to the user.

As shown in FIG. 9, FIG. 5-B and FIG. 6-B, when the status test switch KR-1 is still closed, pressing the reset button 8 closes the reset start switch KR-4, which causes a short between points A and B. The voltages on both ends of A and B are added to the solenoid coil 26, thus causing an electric current to flow through the solenoid coil 26, which generates a magnetic field. The plunger inside the solenoid coil 26 moves. The locking member 30 opens and the reset button 8 can be reset (as shown in FIG. 5-C and FIG. 6-C). At the same time, the reset indicating light V6, i.e., light emitting diode, connected at points A and B is off. Subsequently the status test switch KR-1 is disconnected, and simulated leakage current disappears. After the reset, closing the switches KR2-1, KR2-2, KR3-1, KR3-2 turns on the power output indicating light V7 parallelly connected between the hot wire and neutral wire, indicating that both the power output socket on the surface of the GFCI and the load output end have power output. If the GFCI has come to the end of its life, no major electric current flows through the solenoid coil 26, which is unable to generate a magnetic field. Its built-in plunger will not move the locking member 30, and the reset button will never be able to reset. Neither the power output socket on the surface of the GFCI nor the load output end will have power output. The reset indicating light V6 and the power output indicating light V7 are both off.

As shown in FIG. 5-C and FIG. 6-C, when the GFCI is in the reset position, reset start switch KR-4 or reset conducting apparatus 65-A is again in the closed position since conducting bridge 72 is in its upper position in contact with the upper conducting pieces 66-A and 67-A of "F" shaped pins 66 and 67. The closed state of the reset start switch KR-4 or reset conducting apparatus 65-A indicates the reset status of reset button 8.

When the GFCI is functioned properly, after the GFCI is properly connected to the power line and after the reset button is pressed, the load output end and the surface of the GFCI have power output. The GFCI works normally (as shown in FIG. 5-C and FIG. 6-C). At this time, when an electric leakage current is generated inside the circuit, due to the fact that hot wire and neutral wire both penetrate through the detection coils L1 (200:1) and L2 (1000:1) concurrently, the vector sum of the electric current that penetrates through the detection coil is not zero. The voltage signal passes through the capacitor C9 and is output to the signal input ends 2, 3 of the leakage detection control chip IC (e.g., LM1851) and is negatively fed back into the output ends 5, 4 (public pole) of the leakage detection control chip IC and then fed to the detection coil L2 (1000:1) through the capacitor C1, C2 and the detection coil L1 (200:1). The voltage signal is then sent back to the signal input ends 3, 2 of the leakage detection control chip IC through the capacitor C9. The signal is amplified and a release signal is output from pin 1 of the leakage detection control chip IC to the gate of silicon controlled rectifier V5. The silicon controlled rectifier V5 is triggered, the positive pole and the negative pole are turned on, thus causing point B on the positive pole of the silicon controlled rectifier V5 to have a low electric potential. Since the reset start switch KR-4 is in closed state, points A and B are the same. Because the other end of the solenoid coil 26 is connected to the hot wire, a voltage differential is present at the ends of the solenoid coil 26. Thus, an electric current flows through the solenoid coil 26 and generates a magnetic field. Its internal plunger 42 moves, causing the GFCI to trip and the reset button to release and cut off power output. As shown in FIG. 5-A and FIG. 6-A, the power output indicating light V7 is off and the reset indicating light V6 comes on.

As shown in FIG. 5-A and FIG. 6-A, when the GFCI is in the tripped state, reset start switch KR-4 or reset conducting apparatus 65-A is in an open state since conducting bridge 72 is positioned between the recessed slots 66-C and 67-C of the two "F" shaped conducting pins 66 and 67. The open state of the reset start switch KR-4 or reset conducting apparatus 65-A indicates the release status of reset button 8.

FIG. 7-A is a partial cross-sectional view along the C-C line in FIG. 3, illustrating the GFCI when it works normally with power output. FIG. 7-B is a partial cross-sectional view along the C-C line in FIG. 3, illustrating the GFCI the instant the test button is pressed. FIG. 7-C is a partial cross-sectional view along the C-C line in FIG. 3 illustrating the GFCI when the test button is pressed and the GFCI is tripped with no power output. FIG. 7-D is a partial cross-sectional view along the C-C line in FIG. 3, illustrating the GFCI when the test button is continually pressed to forcibly release the GFCI and to cut off the power output of the GFCI.

Pressing the test button 7 may manually simulate an electric leakage current to detect whether the GFCI has come to the end of its life. Continually pressing the test button 7 may forcibly and mechanically cut off the power output of the GFCI. As shown in FIG. 7-A, the rotatable spoon shaped rotatable tripping lever 37 is arranged directly below the test button 7. The rotatable tripping lever 37 is arranged inside the directional slot 41-D in the front end of the solenoid coil 26 and can rotate around the lever axis 37-D. The small V shaped slots 37-A and 37-B are arranged on the rotatable tripping lever 37. The downwardly extended pointed tip of the test button's arm 40A, in which a slipped over spring 40 penetrates, is arranged inside the V shaped slots 37-A and 37-B. By pressing the test button 7, its downwardly extended arm 40A causes the rotatable tripping lever 37 to rotate around the lever axis 37-D by pushing against the V shaped slots 37-A and 37-B. The upwardly inclined handle 37-C of the spoon shaped rotatable tripping lever 37 penetrates through the hole 32 at the top of the locking member 30 near the test button 7. A pair of spring pieces 46 and 47 are arranged on the opposite side of the upwardly inclined handle 37-C of the spoon shaped rotatable tripping lever 37.

The upper ends of the spring pieces 46 and 47 are open. When the test button 7 is not pressed, since the rotatable tripping lever 37 is not rotating, the upper ends of the spring pieces 46 and 47 do not come into contact. The lower end of the spring piece 46 is soldered onto the printed circuit board 18 and is connected to the neutral wire of the power input end through a resistor (R3 in FIG. 9). The lower end of the spring piece 47 is also soldered onto the printed circuit board 18 and is connected to the hot wire of the power output end.

As shown in FIG. 7-B, pressing down on the test button 7 to a first position causes the lower end of the test button 7 to press against the top surface 37-A of the rotatable tripping lever 37, which causes the rotatable tripping lever 37 to rotate around the lever axis 37-D and to push the spring piece 46. When the spring piece 46 makes contact with the spring piece 47, an electric leakage current is artificially generated. If the GFCI works normally and has protective functions against any electric leakage current, as shown in FIG. 7-C, the GFCI's mechanical tripping device moves the locking member 30 and causes the reset button 8 to release or trip, thus cutting off the power output of the GFCI.

If pressing the test button 7 from a static state to the first position to generate the electric leakage current will not trip the GFCI, this indicates that the GFCI has come to the end of its life. As shown in FIG. 7-D, a user may continue to press the test button 7 down to a second position to forcibly cut off the power output of the GFCI through a mechanical device. As shown in FIG. 7-D, when the GFCI has come to the end of its life and cannot be tripped, continue pressing the test button 7 causes the downwardly extended arm 40A of the test button 7 to continue to press the top surface 37-A of the rotatable tripping lever 37, so that the rotatable tripping lever 37 continues to rotate around the lever axis 37-D. The upwardly inclined handle 37-C of the rotatable tripping lever 37 extending into the through hole 32 of the locking member 30 pulls the locking member 30, so that the circular recessed locking slot 36 of the reset directional lock 35 jumps out of through hole 31 of the locking member 30. The tripper 28 drops down, causing the flexible input metal pieces 50 and 51, and the flexible output metal pieces 20 and 21 to drop down at the same time, which causes their movable contacts to be disconnected from the power output conductors 13 and 14. The power output conductors 13, 14 and the power output end 80, 81 are not energized, forcibly cutting off the power output of the GFCI.

When there is a need to test whether functions of the GFCI are normal, a user may also press the test button 7 to cause the upper ends of spring pieces 46, 47 to come into contact, generating a simulated leakage current. If the GFCI works normally and has not come to the end of its life, the differential transformer will detect a voltage signal and output the voltage signal to the signal input ends 2, 3, 5 of the leakage detection control chip IC. Pin 1 of the leakage detection control chip IC outputs an electric leakage current trigger signal, which is output to the gate of the silicon controlled rectifier V5, so that the silicon controlled rectifier V5 is triggered and turned on, and the circuit interrupting device is tripped. Since at the reset start switch KR-4 is open, an electric current path is formed from the hot wire through the solenoid coil 26, the resistor R4, the reset indicating light V6, and the silicon controlled rectifier V5 to the grounding terminal. The reset indicating light V6 is on, indicating that the functions of the GFCI are functioned properly and the GFCI can be reset. When the GFCI has come to the end of its life, a failure of the internal components may interrupt the electric leakage current detection functions. Pin 1 of the leakage detection control chip IC does not have any control signal output, and the silicon controlled rectifier V5 cannot be triggered. The reset indicating light V6 is off, and the solenoid coil 26, after the power output of the GFCI being forcibly cut off, cannot be energized. Therefore, pressing the reset button 8 cannot complete the reset. This indicates that the GFCI has experienced an internal failure. In other words, the GFCI has come to the end of its life and should be promptly replaced.

If the failure of the GFCI is not eliminated, the mechanical tripping device cannot function. The GFCI does not have power output.

In the circumstances above, the control signal from pin 1 of the leakage detection control chip IC passes through and filters by an anti-interference capacitor C7 between the control end of the silicon controlled rectifier V5 and the grounding terminal to prevent any unintentional triggering.

As shown in FIG. 9, when an electrician erroneously connects the power line inside the wall to the output end of the GFCI, the GFCI can automatically prevent the generation of a simulated leakage current. The leakage detection control chip IC cannot generate a control signal, the silicon controlled rectifier V5 cannot be turned on, and no electric current flows through the solenoid coil 26, so that the solenoid coil 26 cannot generate a magnetic field to push its built-in plunger. As a result, the mechanical tripping device cannot move, and the reset button 8 cannot be reset. The switches KR-3-1, KR-2-1, KR-3-2, KR-2-2 that are coupled to the reset button 8 cannot be closed. The power input end of the GFCI "LINE" and the power output sockets 5, 6 on the face of the front lid 2 of the GFCI do not have power output. The reset indicating light V6 is off, indicating a wiring error. It is only after the electrician wires properly that the reset indicating light V6 is on and the reset button 8 can be reset, and the power output end of the GFCI and the power output sockets 5, 6 on the face of the front lid 2 of the GFCI will have power output.

As shown in FIG. 9, FIG. 1 and FIG. 5-A, a red reset indicating light V6 (R) is arranged on the printed circuit board 18 to indicate whether the GFCI has come to the end of its life. A green or yellow power output indicator V7 (G) is arranged on the mid-level support 3 to indicate the status of the GFCI, e.g., whether there is power output. The reset indicating light V6 and the power output indicating light V7 deflect the light emitted through a light guide tube D onto the surface of the GFCI, so that the light is exposed from the status indicating light hole 30-A as shown in FIG. 2. When the power input end of the GFCI is properly connected to the hot wire and the neutral wire inside the wall, as long as the GFCI has not come to the end of its life and still has protective functions against electric leakage current, the reset indicating light V6 is on. If the GFCI has come to the end of its life, the reset indicating light V6 does not come on. When GFCI has not come to the end of its life and has reset, the reset indicating light V6 is off and the power output indicator V7 is on. Therefore, the user can determine whether the GFCI has come to the end of its life and determined its status by the state of the indicating lights V6 and V7.

As shown in FIG. 4, two pairs of position limiting pieces 43, 44 are arranged below the flexible power output metal pieces 20, 21.

Based on the above description, since the present invention uses the above technical solution, the GFCI disclosed by the present invention has the following functions:

(1) After the power input end of the GFCI is properly connected to the power line inside the wall, a simulated leakage current can be automatically generated to detect whether the GFCI still has protective functions against any electric leakage current, that is, whether it has come to the end of its life. The result is automatically displayed.

When the internal components of the GFCI are intact and the reset indicating light is constantly on, it indicates that a proper reset mechanism can be automatically set up and reset is possible. After a reset, the reset indicating light off and the power output indicating light is constantly on, indicating that the GFCI can work normally.

When the internal components of the GFCI have an open or short circuit, that is, when they come to the end of their lives, the reset indicating light does not come on, indicating that the GFCI has come to the end of its life. The reset button cannot be reset, thus, and the GFCI's output end and the power output sockets on the surface of the GFCI do not have any power output.

(2) The GFCI has mechanical release capabilities.

When components inside the GFCI do not function, especially when the solenoid coil fails, the GFCI can be forcibly tripped or released by mechanical means, thus forcibly cutting off its power output. As a result the GFCI that has come to the end of its life cannot be reset.

(3) The GFCI has manual detection capabilities and can automatically display the detection result.

When an electric leakage current is generated by manual simulation and the GFCI can be tripped or released, the reset indicating light is constantly on, indicating that the GFCI can work normally and can be reset. After the reset, the power output indicator is constantly on.

When an electric leakage current is generated by manual simulation and the GFCI cannot be tripped or released, the reset indicating light is off, indicating that the GFCI has come to the end of its life. The present invention can prevent the reset button from being reset, thus causing the power output socket on the surface of the GFCI and the load output end not to have power output.

(4) The GFCI can prevent reverse wiring errors.

When an electrician erroneously connects the power line inside the wall to the power output end of the GFCI, the present invention can automatically prevent the generation a simulated leakage current. The electric leakage current detection chip IC cannot generate a control signal, the silicon controlled rectifier V5 cannot be turned on, no electric current flows through inside the solenoid coil, no magnetic field can be generated to push its built-in plunger to move to disable the mechanical tripping device, the reset button can never be reset and the switches KR-3-1, KR-2-1, KR-3-2, KR-2-2 coupled to the reset button cannot be closed. The power input end of the GFCI "LINE" and the power output sockets on the surface of the GFCI do not have power output. The reset indicating light V6 is off, indicating a wiring error. It is only when the installer properly connects the lines that the reset indicating light V6 will be on, the reset button can be reset, and the power output end of the GFCI and the power output sockets on the surface of the GFCI have power output.

The exemplary GFCI can be widely applied, is safe and easy to use, thus effectively ensuring the personal safety of the user as well as the safety of appliances.

While the GFCI with an automatic end-of-life test has been described in connection with an exemplary embodiment, those skilled in the art will understand that many modifications in light of these teachings are possible, and this application is intended to cover variations thereof. Therefore, the scope of the appended claims should be accorded the broadest interpretation so as to encompass all such modifications.

We claim:

1. A circuit interrupting device which is capable of establishing or disconnecting electrical continuity between a power source, an output load and a user accessible load;

said circuit interrupting device comprising:

a reset button; and a reset conducting apparatus which comprises a reset start switch (KR-4) operationally connecting to said reset button so that when said circuit interrupting device is wired properly, a depression of said reset button allows said KR-4 switch to close;

said KR-4 comprising:

a first conducting pin having a first end and a second end, wherein said first end of said first conducting pin is adapted to electrically connect to ground via a silicon controlled rectifier (SCR);

a second conducting pin having a first end and a second end, wherein said first end of said second conducting pin is adapted to electrically connect to a hot wire at an input end of a power source via a solenoid coil; and a conducting bridge which connects to said second end of said first conducting pin and said second end of said second conducting pin when said reset button is depressed so as to establish said electrical continuity of said circuit interrupting device when said circuit interrupting device is wired properly.

2. The circuit interrupting device according to claim 1, wherein said circuit interrupting device is a ground fault circuit interrupter, an arc fault circuit interrupter, an immersion detection circuit interrupter, an appliance leakage circuit interrupter, or a circuit breaker.

3. The circuit interrupting device according to claim 1, wherein said circuit interrupting device further comprises a tripping device comprising:

a tripper which contains an aperture to receive a directional lock extended from said reset button;

a locking device having a locking spring and containing a first through hole and a second through hole; wherein said first through hole is capable of aligning with said aperture of said tripper to receive said directional lock extended from said reset button; and wherein said locking device threads through said tripper; and said solenoid coil (SOL) having a plunger; wherein when said SOL is energized, said plunger plunges onto a side wall of said locking device causing said first through hole to align with said aperture of said tripper to reset or trip said circuit interrupting device so as to connect or disconnect said electrical continuity of said circuit interrupting device.

4. The circuit interrupting device according to claim 3, wherein said reset conducting apparatus is located at the bottom of said tripper.

5. The circuit interrupting device according to claim 1, wherein each of said second end of said first conducting pin and said second conducting pin comprises an upper conducting piece and a lower conducting piece separated by a recessed slot;

wherein said conducting bridge is rested at said recessed slot between said upper conducting piece and said lower conducting piece and not connected to said first and said second conducting pins when said circuit interrupting device is at a tripped state; and wherein said conducting bridge is pressed against each of said lower conducting piece of said first and second conducting pins when said reset button is depressed.

6. The circuit interrupting device according to claim 5, wherein said reset conducting apparatus further comprises a reset switch box having a spring receiving slot;

wherein a directional spring is located between said conducting bridge and said spring receiving slot of said reset switch box;

whereby when said reset button is depressed, said directional spring is compressed to allow said conducting bridge to press against each of said lower conducting piece of said first and second conducting pins; and whereby when said reset button and said tripper are in the release state, said conducting bridge is rested at said recessed slot between said upper conducting piece and said lower conducting piece; and whereby when said reset button is reset, said directional spring is relaxed which allows said conducting bridge to be contacted with each of said upper conducting piece of said first and said second conducting pins.

7. The circuit interrupting device according to claim 3, wherein said second through hole of said locking device receives an upward inclined handle of a rotatable tripping lever; and wherein said rotatable tripping lever further comprises a pair of rotating shafts protruding on both sides of said rotatable tripping lever, a level axis, and a v-shaped slot capable of receiving an end of an arm extended from a test button.

8. The circuit interrupting device according to claim 7, wherein said pair of rotating shafts on said rotatable tripping lever are secured in a pair of vertical directional slots within a solenoid coil support.

9. The circuit interrupting device according to claim 7, wherein a pair of metal pieces are situated along a side of said rotatable tripping lever in said solenoid coil support; wherein said pair of metal pieces does not contact with each other when said rotatable tripping lever is not rotated; wherein when said rotatable tripping lever is rotated upward, said side of said rotatable tripping lever pushes said pair of metal pieces to be in contact with each other.

10. The circuit interrupting device according to claim 9, wherein one of said pair of said metal pieces is adapted to electrically connect to a neutral wire at said input end of said power source via a resistor; and wherein the other one of said pair of said metal pieces is adapted to electrically connect to a hot wire of an output end.

11. The circuit interrupting device according to claim 7, wherein said test button has a first level and a second level of depression.

12. The circuit interrupting device according to claim 11, wherein when said test button is depressed at said first level, said end of said extended arm of said test button pushes said v-shaped slot of said rotatable tripping lever to cause said rotatable tripping lever to rotate around said lever axis and thereby pushes said pair of metal pieces to be in contact with each other, thereby simulated a fault to test components of said circuit interrupting device.

13. The circuit interrupting device according to claim 11, wherein a depression of said test button at said second level causes said circuit interrupting device to be mechanically tripped.

14. The circuit interrupting device according to claim 12, wherein said components of said circuit interrupting device tested by said depression of said test button at said first level comprise a differential transformer (DT), an integrated circuit (IC), said silicon controlled rectifier (SCR), and said solenoid coil (SOL).

15. The circuit interrupting device according to claim 1, further comprising a first pair of flexible metal pieces and a second pair of flexible metal pieces;

wherein one end of each of said first pair of flexible metal pieces passes through a differential transformer and is operationally connected to a hot power input end or a neutral power input end; the other end of each of said first pair of flexible metal pieces having a movable contact point;

wherein one end of each of said second pair of flexible metal pieces is operationally connected to a hot power output end or a neutral power output end; the other end of each of said second pair of flexible metal pieces having a movable contact point.

16. The circuit interrupting device according to claim 15, further comprising a pair of output conductors connected to said user accessible load and positioned in said housing; wherein each of said output conductors contains a pair of fixed contact points;

wherein said movable contact point of each of said first pair of flexible metal pieces and said movable contact point of each of said second pair of flexible metal pieces are capable of connecting/disconnecting to each of said fixed contact points of said pair of output conductors respectively.

17. The circuit interrupting device according to claim 15, wherein each of said first pair of said flexible metal pieces and each of said second pair of said flexible metal pieces are soldered on a circuit board and are not directly connected to said input end and said output end.

18. The circuit interrupting device according to claim 16, wherein each of said movable contact points of said first pair of said flexible metal pieces is in a different cross sectional plane from said each of said movable contact points of said second pair of said flexible metal pieces; and wherein said first pair of said flexible metal pieces and said second pair of said flexible metal pieces are above a pair of cantilever arm at both sides of a tripper.

19. The circuit interrupting device according to claim 16, wherein each of said pair of said output conductor comprises a pair of gripping wing pieces protruded to output socket holes at a front lid of said housing.

20. The circuit interrupting device according to claim 16, wherein when each of said movable contact point of each of said first pair of flexible metal pieces is connected to each of said fixed contact points of said pair of output conductors, electrical current is conducted from said power source to said user accessible load; and wherein when each of said movable contact point of each of said second pair of flexible metal pieces is connected to each of said fixed contact points of said pair of output conductors, electrical current is conducted from said user accessible load to said output load.

21. The circuit interrupting device according to claim 15, wherein a simulated leakage current controlling resistor is located underneath one of said first pair of flexible metal pieces which is adapted to electrically connected to a neutral wire of said input end;

wherein said simulated leakage current controlling resistor has a first end and a second end; said first end of said simulated leakage current controlling resistor being capable of contacting with said one of said first pair of flexible metal pieces; said second end of said simulated leakage current controlling resistor being adapted to electrically connect to said hot wire of said input end via said solenoid coil (SOL); and wherein said simulated leakage current controlling resistor and said one of said first pair of flexible metal pieces form a status test switch (KR-1).

22. The circuit interrupting device according to claim 21, wherein when said circuit interrupting device is powered on and at a tripped state, said KR-1 is closed due to said simulated leakage current controlling resistor contacting with said one of said first pair of flexible metal pieces; and wherein said KR-1 is closed without a depression of said reset button.

23. The circuit interrupting device according to claim 21, wherein when said circuit interrupting device is reset, said KR-1 is opened due to said simulated leakage current controlling resistor separating from said one of said first pair of flexible metal pieces.

24. The circuit interrupting device according to claim 22, wherein when said KR-1 is closed, said circuit interrupting device is automatically performing a test of components of said circuit interrupting device.

25. The circuit interrupting device according to claim 24, wherein said components of said circuit interrupting device comprises a differential transformer, an integrated circuit, said silicon controlled rectifier (SCR), and said solenoid coil.

26. The circuit interrupting device according to claim 21, wherein a pair of hooked pins are positioned above said first pair of flexible metal pieces;

wherein said pair of hooked pins having an upper end and a lower end; each of said upper end of said hooked pins being clamped to a mid-level support within said housing; each of said lower end of said hooked pins having a cylindrical platform being pressed on each of said pair of flexible metal pieces when said circuit interrupting device is powered on and at said tripped state to cause said simulated leakage current controlling resistor to be in close contact with said one of said first pair of flexible metal pieces so as to generate a simulated leakage current.

27. The circuit interrupting device according to claim 26, wherein each of said pair of hooked pins comprises a spring at outside of each of said pair of hooked pins.

28. The circuit interrupting device according to claim 24, wherein a reset indicating light is lit when said components are functioned properly.

29. The circuit interrupting device according to claim 28, further comprising a power output indicator light; wherein said power output indicator light is lit when said circuit interrupting device has power output.

30. The circuit interrupting device according to claim 28, wherein one end of said reset indicating light is connected to a negative pole of said power source through said silicon controlled rectifier (SCR) and the other end is connected to said hot wire of said input end of said power source through a resistor and said solenoid coil.

31. The circuit interrupting device according to claim 1, wherein said solenoid coil has a coil protection cover placed at outside of said solenoid coil.

32. A circuit interrupting device comprising:

a reset button; and a status test switch (KR-1) comprising a flexible metal piece having a first end and a second end;

wherein said first end of said flexible metal piece is soldered to a circuit board; wherein said second end of said flexible metal piece is capable of contacting a simulated leakage current controlling resistor located underneath said flexible metal piece; and wherein said flexible metal piece is adapted to electrically connected to a neutral wire of an input end of a power source;

wherein said simulated leakage current controlling resistor has a first end and a second end; wherein said first end of said simulated leakage current controlling resistor is capable of contacting said flexible metal piece; wherein said second end of said simulated leakage current controlling resistor is adapted to connect to said circuit board and electrically connect to a hot wire of said input end via a solenoid coil;

wherein when said flexible metal piece is adapted to electrically connect to said neutral wire of said input end, said simulated leakage current controlling resistor is adapted to electrically connect to said hot wire of said input end and vise versa;

wherein when said circuit interrupting device is powered on and at a tripped state, without depressing said reset button, said flexible metal piece is in contact with said simulated leakage current controlling resistor so as to close said KR-1; and wherein when said circuit interrupting device is reset, said flexible metal piece is separated from said simulated leakage current controlling resistor to open said KR-1.

33. The circuit interrupting device according to claim 32, wherein when said KR-1 is closed, said flexible metal piece, said simulated leakage current controlling resistor and said solenoid coil form a loop to automatically generate a simulated leakage current to test components of said circuit interrupting device without a depression of said reset button.

34. The circuit interrupting device according to claim 33, wherein said components of said circuit interrupting device comprise a differential transformer, an integrated circuit, said silicon controlled rectifier (SCR), and said solenoid coil.

35. The circuit interrupting device according to claim 32, wherein when said components of said circuit interrupting device are functioned properly, a reset indicating light is lit.

* * * * *